US009682557B2

(12) United States Patent
Owaki

(10) Patent No.: US 9,682,557 B2
(45) Date of Patent: Jun. 20, 2017

(54) LIQUID EJECTING HEAD, LIQUID EJECTING HEAD UNIT, AND LIQUID EJECTING APPARATUS

(71) Applicant: SEIKO EPSON CORPORATION, Tokyo (JP)

(72) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/921,818

(22) Filed: Oct. 23, 2015

(65) Prior Publication Data

US 2016/0121609 A1 May 5, 2016

(30) Foreign Application Priority Data

Oct. 31, 2014 (JP) ..... 2014-223633
May 18, 2015 (JP) ..... 2015-101403

(51) Int. Cl.
*B41J 2/14* (2006.01)

(52) U.S. Cl.
CPC .. *B41J 2/14233* (2013.01); *B41J 2002/14241* (2013.01); *B41J 2002/14491* (2013.01); *B41J 2202/18* (2013.01)

(58) Field of Classification Search
CPC ..... B41J 2/14201; B41J 2/14233; B41J 2002/14241; B41J 2/04521; B41J 2/14072; B41J 2202/18; B41J 2002/14491
See application file for complete search history.

(56) References Cited

U.S. PATENT DOCUMENTS

2007/0285470 A1* 12/2007 Kanaya ..... B41J 2/14233 347/63
2009/0201346 A1 8/2009 Miyata et al.
2011/0205270 A1 8/2011 Miyata

FOREIGN PATENT DOCUMENTS

JP 2009-208462 A 9/2009
JP 2010-155418 A 7/2010
JP 2011-167956 A 9/2011

* cited by examiner

*Primary Examiner* — Geoffrey Mruk
(74) *Attorney, Agent, or Firm* — Workman Nydegger

(57) ABSTRACT

A liquid ejecting head includes a first nozzle row in which nozzles which eject a liquid are juxtaposed along a first direction, first drive elements which cause the liquid to be ejected from each nozzle of the first nozzle row, a plurality of first individual wirings which are connected to the first drive elements, a first common wiring which is connected in common to the first drive elements, a second nozzle row in which nozzles are juxtaposed along the first direction, second drive elements which cause the liquid to be ejected from each nozzle of the second nozzle row, a plurality of second individual wirings which are connected to the second drive elements, and a second common wiring which is connected in common to the second drive elements and is not connected to the first common wiring. The plurality of first individual wirings, the first common wiring, the second individual wirings, and the second common wiring are connected to a common flexible cable.

20 Claims, 16 Drawing Sheets

LIQUID EJECTING HEAD, LIQUID EJECTING HEAD UNIT, AND LIQUID EJECTING APPARATUS

CROSS-REFERENCE TO RELATED APPLICATIONS

The entire disclosure of Japanese Patent Application No.: 2015-101403, filed May 18, 2015 and 2014-223633, filed Oct. 31, 2014 are expressly incorporated by reference herein.

BACKGROUND

1. Technical Field

The present invention relates to a liquid ejecting head which ejects a liquid, a liquid ejecting unit, and a liquid ejecting apparatus. In particular, the invention relates to an ink jet recording head which ejects an ink as the liquid, an ink jet recording head unit, and an ink jet recording apparatus.

2. Related Art

An ink jet recording head which discharges ink droplets is a representative example of the liquid ejecting head which discharges droplets. A known example of the ink jet recording head is provided with a flow path forming substrate and a drive element such as a piezoelectric actuator. A pressure generating chamber which communicates with a nozzle opening is formed in the flow path forming substrate, the drive element is provided on one surface side of the flow path forming substrate, and an ink is ejected from the nozzle opening by generating a pressure change in the ink in the pressure generating chamber using the drive element.

In such an ink jet recording head, wiring is led out from a plurality of drive elements on the flow path forming substrate, and the wiring is electrically connected to a flexible cable (for example, refer to JP-A-2009-208462 and JP-A-2011-167956).

However, as illustrated in JP-A-2009-208462, there is a problem in that when a flexible cable is provided for each row of the drive elements, the size of the ink jet recording head is increased in order to secure a connection region between the flexible cables and the wirings, and costs increase due to the increase in the flexible cables.

As illustrated in JP-A-2011-167956, in a case in which one flexible cable is provided in common for plural rows of the drive elements, when power is supplied to the plural rows of the drive elements in common via the single flexible cable, there is a problem in that, depending on the number of the drive elements which are driven at the same time in one drive element row, so-called crosstalk is generated in which changes arise in the driving, particularly in the power source, of another drive element row, and variation arises in the ejection properties, particularly in the flight speed of ink droplets and the like, of the ink droplets which are ejected from the nozzle openings which correspond to the other drive element row.

Note that, this problem is present not only in an ink jet recording head, but also in the same manner in a liquid ejecting head which ejects a liquid other than an ink.

SUMMARY

An advantage of some aspects of the invention is to provide a liquid ejecting head, a liquid ejecting head unit, and a liquid ejecting apparatus, each of which is capable of reducing the size and cost, and is capable of suppressing crosstalk to suppress the variation in the ejection properties of the liquid.

According to an aspect of the invention, there is provided a liquid ejecting head including a first nozzle row in which nozzles which eject a liquid are juxtaposed along a first direction, first drive elements which cause the liquid to be ejected from each nozzle of the first nozzle row, a plurality of first individual wirings which are connected to the first drive elements, a first common wiring which is connected in common to the first drive elements, a second nozzle row in which nozzles are juxtaposed along the first direction, second drive elements which cause the liquid to be ejected from each nozzle of the second nozzle row, a plurality of second individual wirings which are connected to the second drive elements, and a second common wiring which is connected in common to the second drive elements and is not connected to the first common wiring, in which the plurality of first individual wirings, the first common wiring, the second individual wirings, and the second common wiring are connected to a common flexible cable.

In this aspect, by connecting the first individual wirings, the first common wiring, the second individual wirings, and the second common wiring to the common flexible cable, it is possible to obtain a reduction in size by reducing the space for connecting, and it is possible to reduce costs by reducing the number of flexible cables. By providing the first common wiring and the second common wiring independently without connecting one to the other, it is possible to suppress crosstalk between the first drive elements and the second drive elements, and to suppress the occurrence of variation in the driving of the drive elements.

It is preferable that the flexible cable includes a first common connection wiring which is connected to the first common wiring, and a second common connection wiring which is connected to the second common wiring, and the first common connection wiring and the second common connection wiring are provided independently without being connected to each other on the flexible cable. Accordingly, it is possible to reliably suppress the generation of crosstalk by suppressing conduction between the first common wiring and the second common wiring via the first common connection wiring and the second common connection wiring of the flexible cable.

It is preferable that the first common wiring and the second common wiring each has a plurality of connection regions which are connected to the common flexible cable, a plurality of the first common wirings are disposed on one side in the first direction in relation to the plurality of first individual wirings and the plurality of second individual wirings, and a plurality of the second common wirings are disposed on another side in the first direction in relation to the plurality of first individual wirings and the plurality of second individual wirings. Accordingly, since it is possible to allow an adhesive which is used when joining the first common wiring and the second common wiring to the flexible cable to escape between connection regions which are adjacent in the first direction, it is possible to suppress problems such as connection faults which are caused by excess adhesive.

It is preferable that the first common wiring and the second common wiring each has a plurality of connection regions which are connected to the common flexible cable, a plurality of the first common wirings are disposed on both one side and another side in the first direction in relation to the plurality of first individual wirings and the plurality of second individual wirings, and a plurality of the second common wirings are disposed on both the one side and the other side in the first direction in relation to the plurality of first individual wirings and the plurality of second individual wirings. Accordingly, it is possible to suppress the occurrence of variation in the driving of the drive elements of different positions in the first direction.

It is preferable that the plurality of first individual wirings, the first common wiring, the plurality of second individual wirings, and the second common wiring are disposed to be juxtaposed on a straight line in a connection region in which the same are connected to the common flexible cable. Accordingly, it is possible to easily connect the common flexible cable, and it is possible to obtain a reduction in size by reducing the space for connecting.

It is preferable that areas of connection regions in which the plurality of first individual wirings and the plurality of second individual wirings are connected to the common flexible cable differ from each other. Accordingly, by increasing the area of the connecting portion in which a voltage drop occurs easily, it is possible to suppress the influence of a voltage drop, and to reduce the size by reducing the area of the connecting portion in which a voltage drop does not occur easily.

According to another aspect of the invention, there is provided a liquid ejecting apparatus including the liquid ejecting head according to the above aspect, an intermediate substrate which is connected to the flexible cable, a holding member which holds the intermediate substrate, and an outer wiring substrate, one end of which is connected to the intermediate substrate, the other end of which is connected to a control device, in which the intermediate substrate moves reciprocally relative to the control device, the outer wiring substrate follows the reciprocal movement of the intermediate substrate, and $A*B*C*D \geq 0.007$, where A (V/μsec) is a total of values obtained by dividing each potential difference (V) of charging or discharging of drive waveforms which drive the first drive elements and the second drive elements by a respective charging or discharging time (μsec), B (m) is a length of the outer wiring substrate, C ($m^2$) is a sectional area of the outer wiring substrate, and D (number) is a number of the first drive elements and the second drive elements which are driven.

In this aspect, it is possible to reduce the influence of crosstalk. In particular, even when the driving is carried out using a drive waveform with a large slope for ejecting a droplet of a small dot, or the like, it is possible to suppress crosstalk. Even if a comparatively long outer wiring substrate is used, since it is possible to suppress crosstalk, it is possible to increase the distance of the reciprocal movement of the liquid ejecting head by increasing the length of the outer wiring substrate. Therefore, it is possible to cause the liquid to land on an ejection-target medium which is wide in the direction in which the recording head reciprocates.

According to still another aspect of the invention, there is provided a liquid ejecting head unit including the liquid ejecting head according to the above aspect, an intermediate substrate which is connected to the flexible cable, a holding member which holds the intermediate substrate, and an outer wiring substrate which is connected to the intermediate substrate, in which the flexible cable includes a first common connection wiring which is connected to the first common wiring, and a second common connection wiring which is connected to the second common wiring, the first common connection wiring and the second common connection wiring are provided independently without being connected to each other on the flexible cable, the intermediate substrate includes a first common intermediate wiring which is connected to the first common connection wiring, and a second common intermediate wiring which is connected to the second common connection wiring, the first common intermediate wiring and the second common intermediate wiring are provided independently without being connected to each other on the intermediate substrate, the outer wiring substrate includes a first common outer wiring which is connected to the first common intermediate wiring, and a second common outer wiring which is connected to the second common intermediate wiring, and the first common outer wiring and the second common outer wiring are provided independently without being connected to each other on the outer wiring substrate. Accordingly, it is possible to suppress the generation of crosstalk by suppressing conduction between the first common wiring and the second common wiring via the first common intermediate wiring and the second common intermediate wiring, and via the first common outer wiring and the second common outer wiring.

It is preferable that a plurality of the flexible cables are provided, and the plurality of flexible cables are connected in common to the intermediate substrate. Accordingly, in comparison with a configuration in which an intermediate substrate is provided for each flexible cable, it is possible to obtain a reduction in size, and it is possible to reduce costs by reducing the number of components.

According to still another aspect of the invention, there is provided a liquid ejecting apparatus including the liquid ejecting head according to the above aspect or the liquid ejecting head unit according to the above aspect.

In this aspect, it is possible to reduce the size and costs, and it is possible to realize a liquid ejecting apparatus in which variation of the ejection properties of the liquid is suppressed by suppressing crosstalk.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of the embodiments of the invention.

First Embodiment

Figure 1:
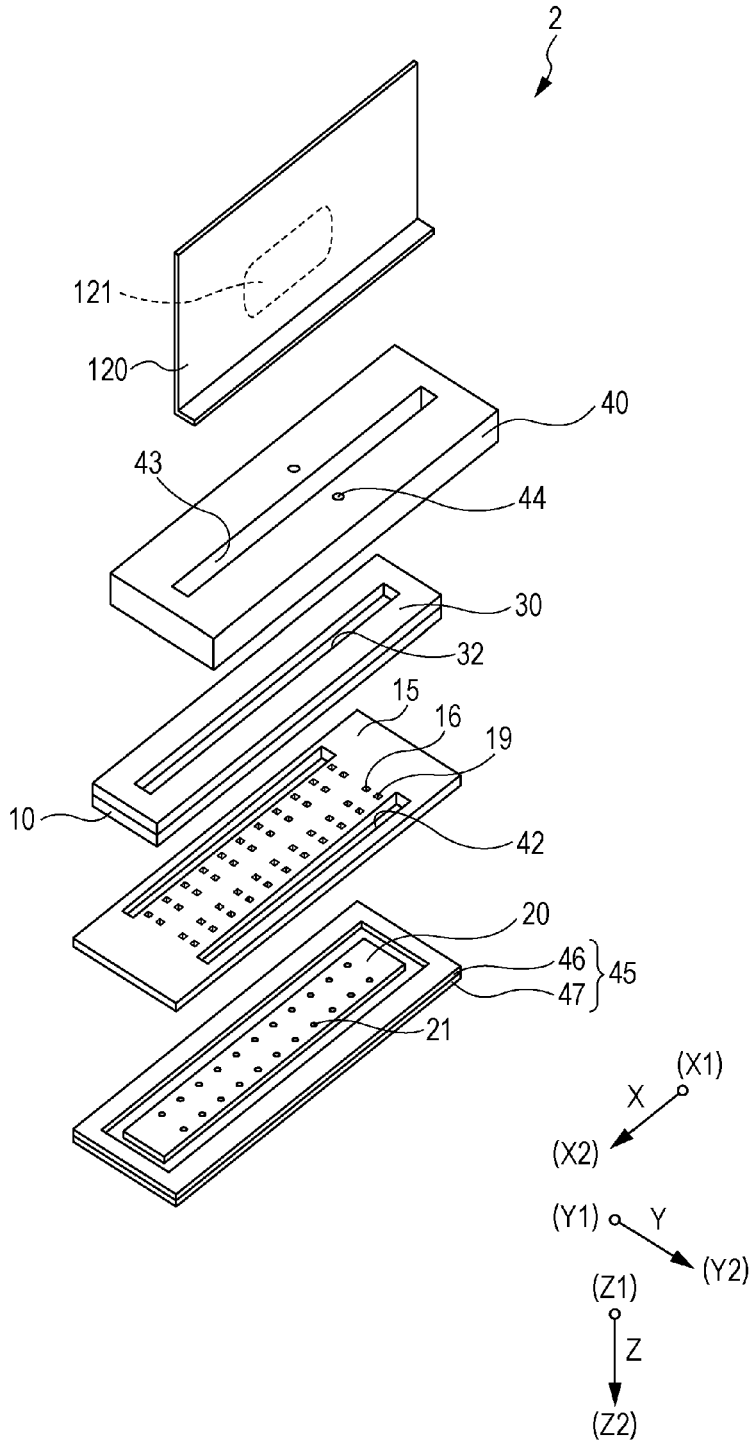
FIG. 1 is an exploded perspective diagram of a recording head according to a first embodiment of the invention.
Figure 2:
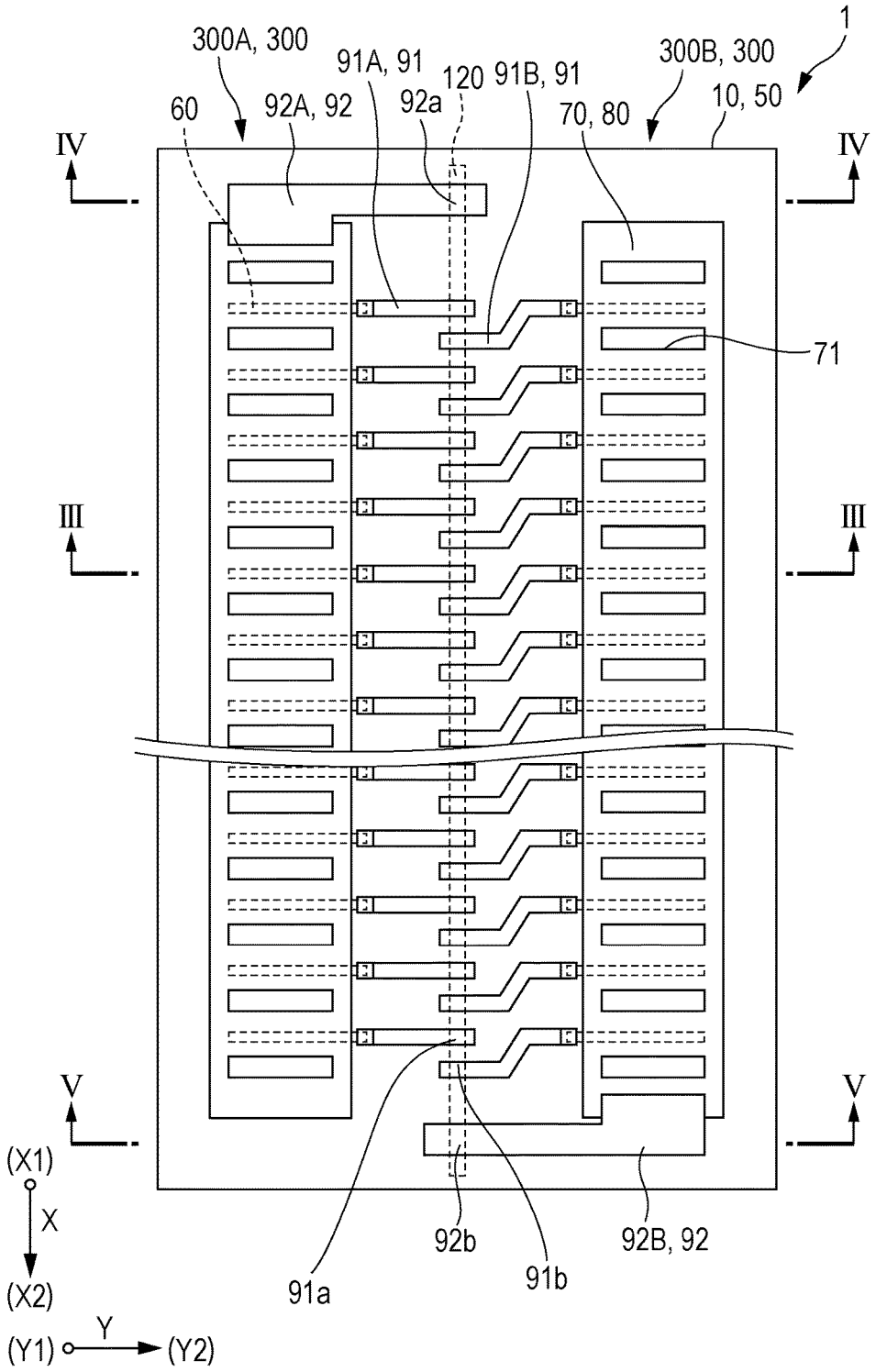
FIG. 2 is a plan view of the main components of the recording head according to the first embodiment of the invention.
Figure 3:
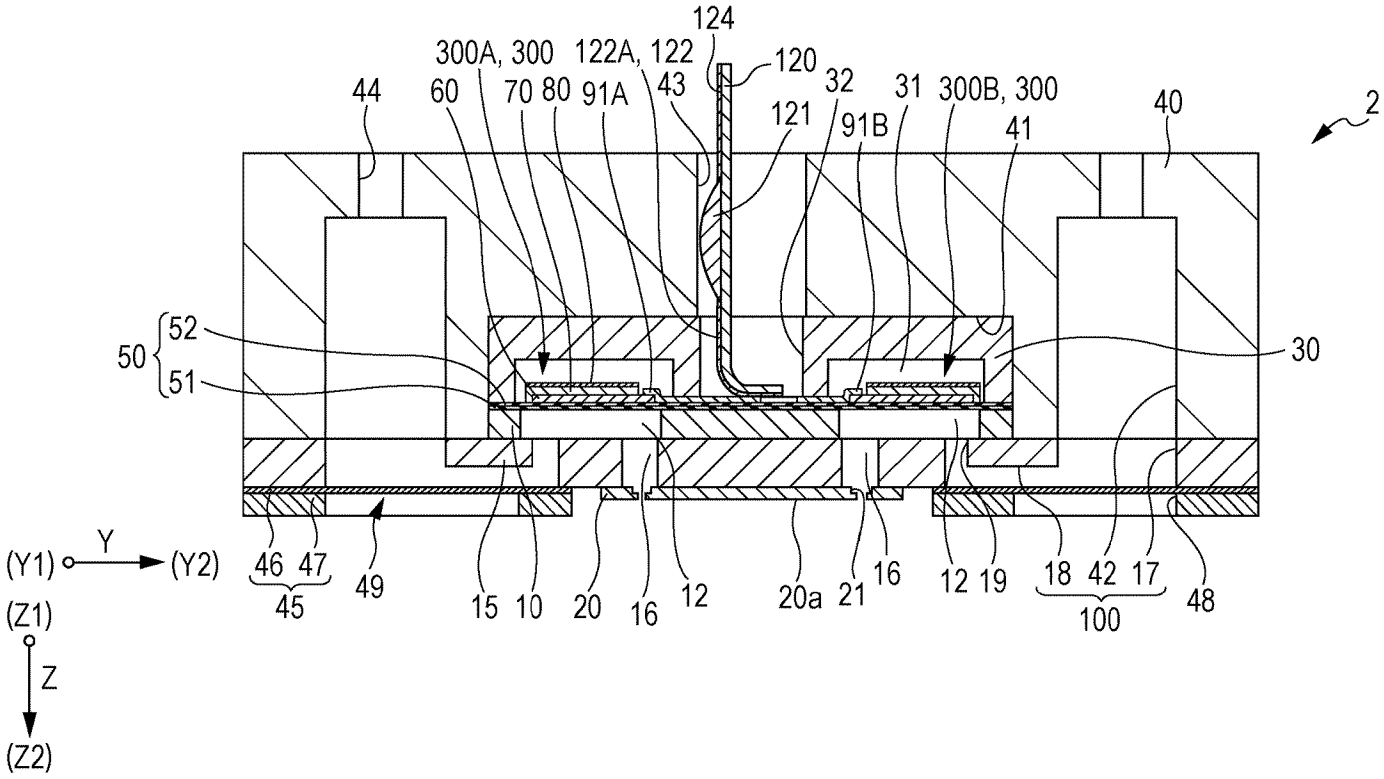
FIG. 3 is a sectional diagram of the recording head according to the first embodiment of the invention.
Figure 4:
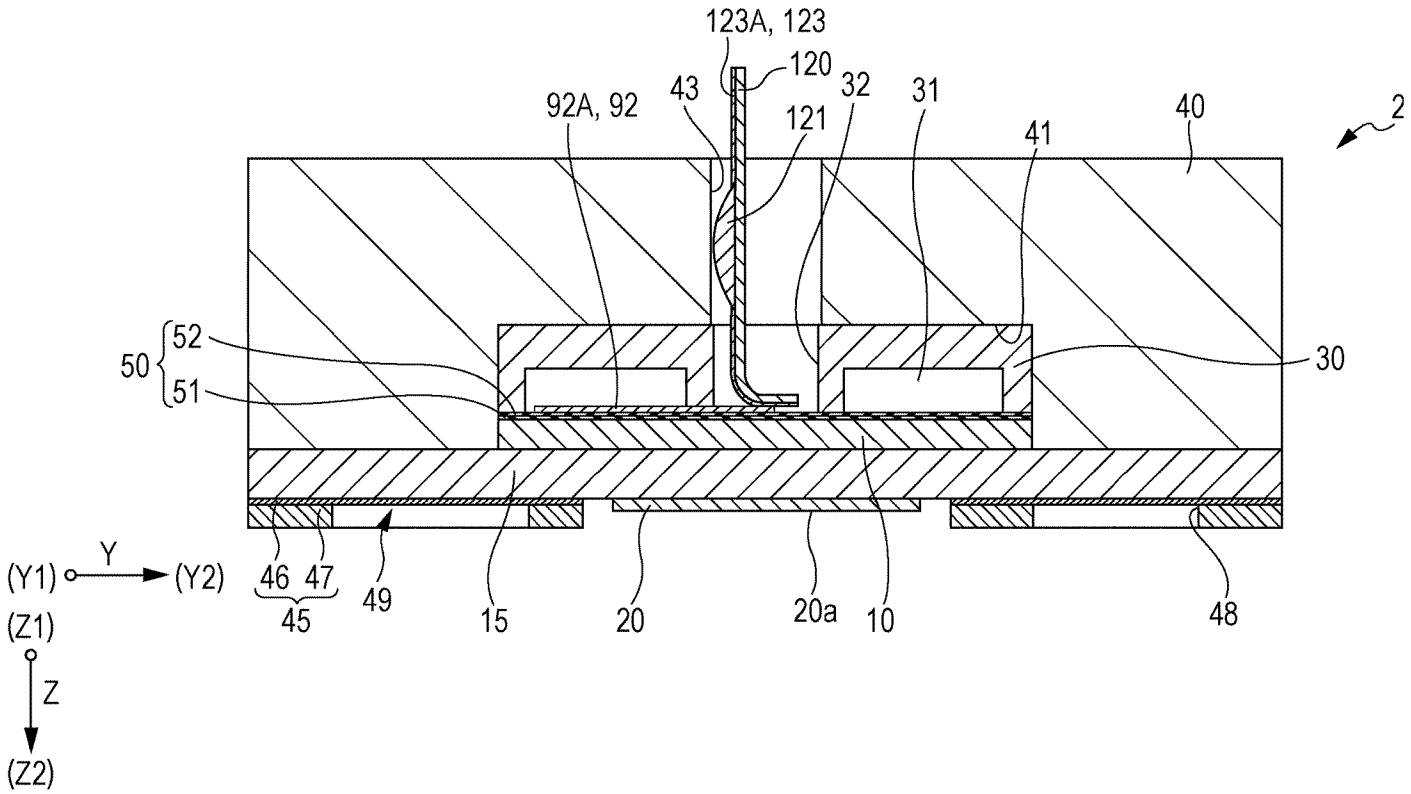
FIG. 4 is a sectional diagram of the recording head according to the first embodiment of the invention.
Figure 5:
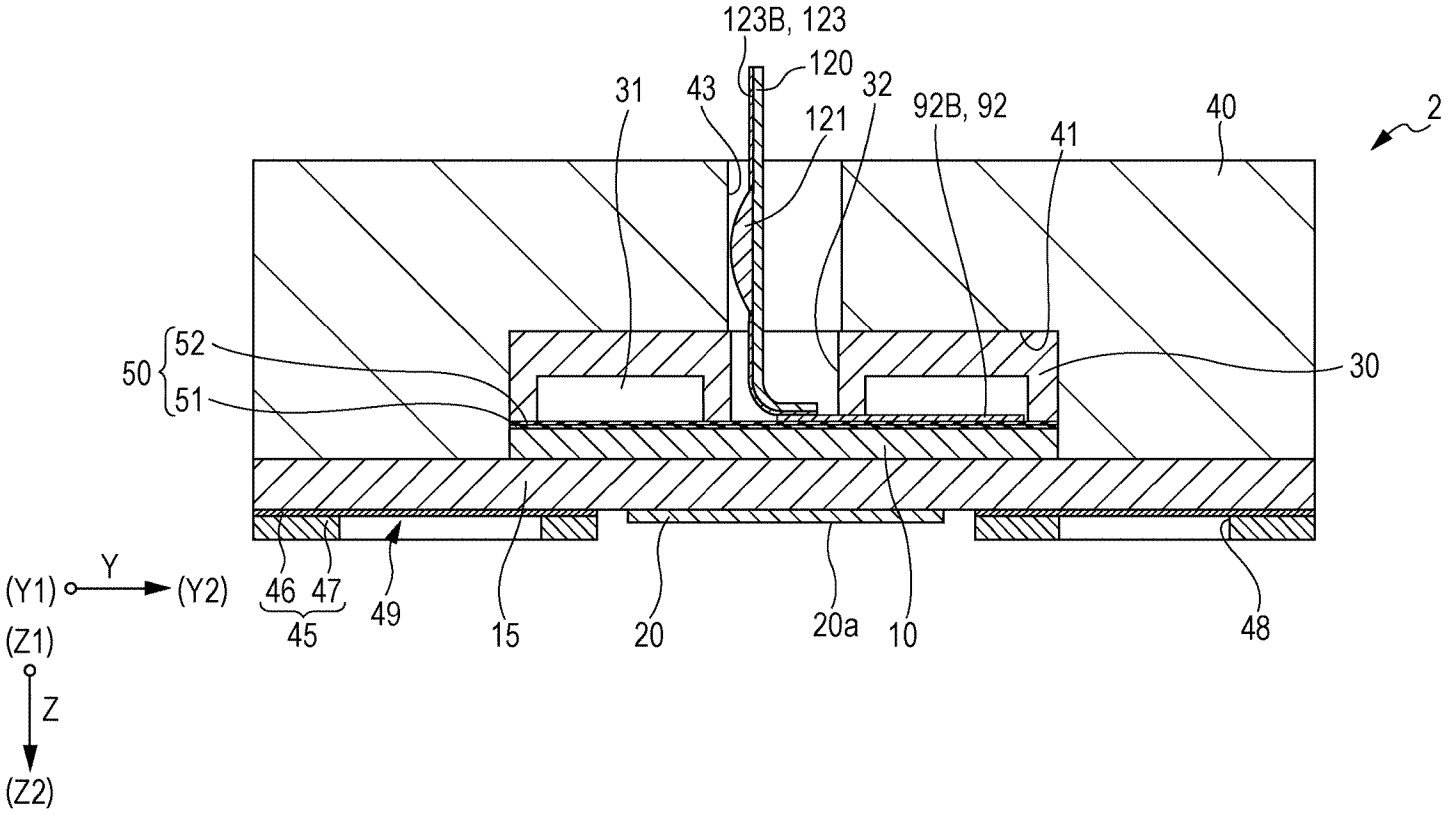
FIG. 5 is a sectional diagram of the recording head according to the first embodiment of the invention.
Figure 6:
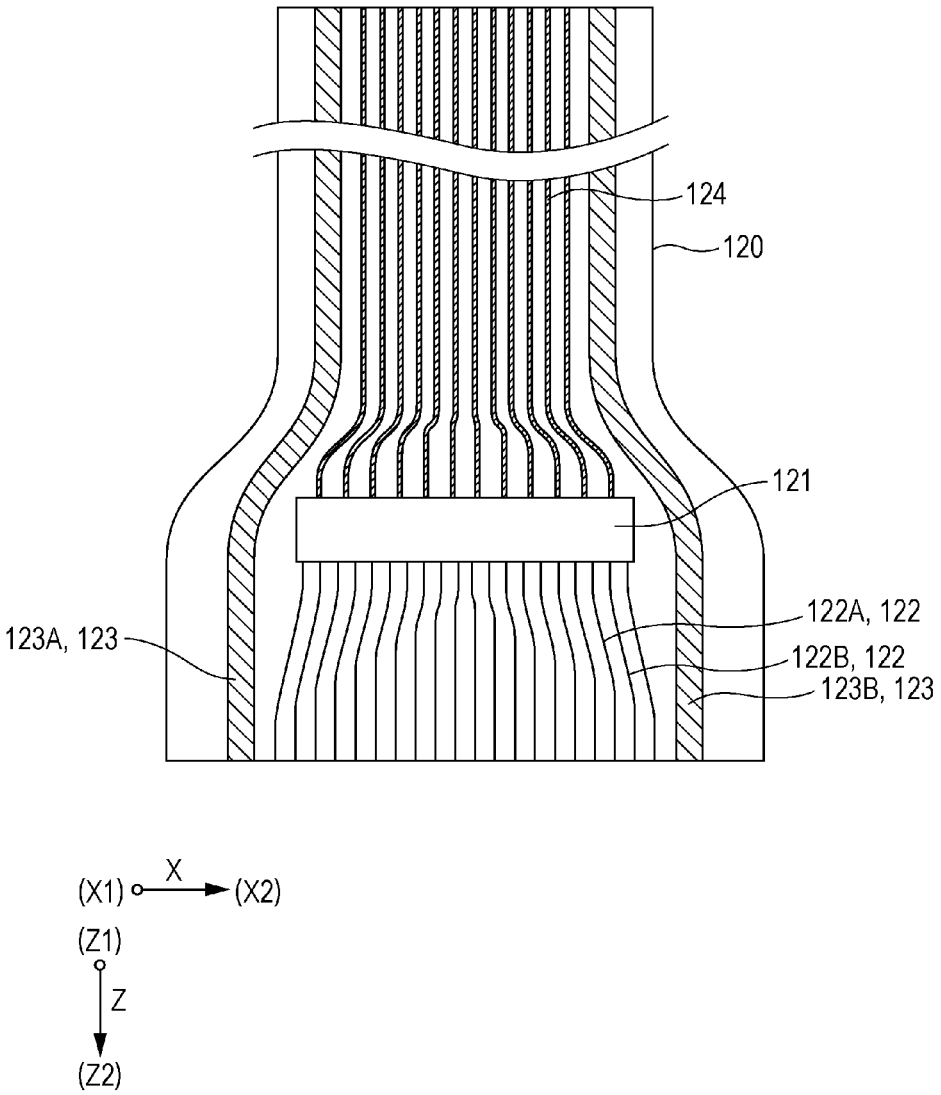
FIG. 6 is a plan view of a flexible cable according to the first embodiment of the invention.

FIG. 1 is an exploded perspective diagram of an ink jet recording head (an example of the liquid ejecting head according to the first embodiment of the invention), FIG. 2 is a plan view of the main components of a flow path forming substrate of the recording head, FIG. 3 is a sectional diagram taken along the III-III line of FIG. 2, FIG. 4 is a sectional diagram taken along the IV-IV line of FIG. 2, FIG. 5 is a sectional diagram taken along the V-V line of FIG. 2, and FIG. 6 is a plan view of the flexible cable.

As illustrated in the drawings, in a flow path forming substrate 10 which configures an ink jet recording head 2 (hereinafter, simply referred to as the recording head 2) of the present embodiment, pressure generating chambers 12, which are partitioned by a plurality of partition walls, are juxtaposed along a direction in which a plurality of nozzle openings 21 which eject an ink are juxtaposed using anisotropic etching from the first surface side. Hereinafter, this direction will be referred to as a juxtaposition direction of the pressure generating chambers 12, or as a first direction X. A plurality of rows (in the present embodiment, two rows) of the pressure generating chambers 12 which are juxtaposed in the first direction X are provided in the flow path forming substrate 10. The direction in which the plurality of rows of the pressure generating chambers 12 are provided to line up will be referred to as a second direction Y hereinafter. A direction which orthogonally intersects both the first direction X and the second direction Y will be referred to as a third direction Z. Note that, although the first direction X, the second direction Y, and the third direction Z are directions that orthogonally intersect each other, the directions are not limited thereto, and may be directions which intersect each other at an angle other than orthogonal.

A communicating plate 15, and a nozzle plate 20 are sequentially laminated onto the first surface side of the flow path forming substrate 10 in the third direction Z.

Nozzle communicating paths 16 which communicate the pressure generating chambers 12 with the nozzle openings 21 are provided in the communicating plate 15. The communicating plate 15 has a larger area than the flow path forming substrate 10, and the nozzle plate 20 has a smaller area than the flow path forming substrate 10. Since the nozzle openings 21 of the nozzle plate 20 and the pressure generating chamber 12 are separated by providing the communicating plate 15 in this manner, the ink within the pressure generating chamber 12 is not easily influenced by an increase in viscosity caused by the evaporation of water content in the ink, which occurs in the vicinity of the nozzle opening 21. Since it is sufficient for the nozzle plate 20 to only cover the opening of the nozzle communicating paths 16 that communicate the pressure generating chambers 12 with the nozzle openings 21, it is possible to comparatively reduce the area of the nozzle plate 20 and it is possible to obtain a reduction in costs. Note that, in the present embodiment, a surface in which the nozzle openings 21 of the nozzle plate 20 are opened and from which ink droplets are discharged is referred to as a liquid ejecting surface 20*a*.

The communicating plate 15 is provided with a first manifold portion 17 and a second manifold portion 18, which configure a portion of a manifold 100.

The first manifold portion 17 is provided to penetrate the communicating plate 15 in the third direction Z.

The second manifold portion 18 does not penetrate the communicating plate 15 in the third direction, and is provided to be open to the nozzle plate 20 side of the communicating plate 15.

The communicating plate 15 is provided with a supply communicating path 19 that communicates with the first end portion of the pressure generating chamber 12 in the second direction Y, independently for each of the pressure generating chambers 12. The supply communicating paths 19 communicate the second manifold portion 18 with the pressure generating chambers 12. In other words, the supply communicating paths 19 are juxtaposed in the first direction X in relation to the manifold 100.

The nozzle openings 21 which communicate with each of the pressure generating chambers 12 via the nozzle communicating paths 16 are formed in the nozzle plate 20. In other words, the nozzle openings 21, which eject the same type of liquid (ink) are juxtaposed in the first direction X, and two rows of the nozzle openings 21 that are juxtaposed in the first direction X are formed in the second direction Y.

Meanwhile, a diaphragm 50 is formed on the opposite surface side of the flow path forming substrate 10 from the communicating plate 15. In the present embodiment, an elastic film 51 and an insulating film 52 are provided as the diaphragm 50. The elastic film 51 is provided on the flow path forming substrate 10 side and is formed from silicon oxide, and the insulating film 52 is provided on the elastic film 51 and is formed from zirconium oxide. Note that, the liquid flow paths of the pressure generating chambers 12 and the like are formed by subjecting the flow path forming substrate 10 to anisotropic etching from the first surface side (the side of the surface to which the nozzle plate 20 is joined), and the second surface of the pressure generating chambers 12 is formed by being partitioned by the elastic film 51.

A piezoelectric actuator 300 which includes a first electrode 60, a piezoelectric layer 70, and a second electrode 80 is provided on the diaphragm 50 of the flow path forming substrate 10. In the present embodiment, the piezoelectric actuator 300 is a drive element which is driven by a drive circuit 121 which is a semiconductor element (described later in detail). Here, in the present embodiment, the first electrodes 60 are separated out for each of the pressure generating chambers 12, and form individual electrodes which are independent of each other for each functional unit (described later in detail). The first electrode 60 is formed with a narrower width than the width of the pressure generating chamber 12 in the second direction Y of the pressure generating chamber 12. In other words, the end portion of the first electrode 60 is positioned on the inside of a region which faces the pressure generating chamber 12 in the first direction X of the pressure generating chamber 12. Both end portions of the first electrode 60 extend to the outside of the pressure generating chamber 12 in the second direction Y.

The piezoelectric layer 70 is provided continuously across the first direction X so as to reach a predetermined width in the second direction Y. The width of the piezoelectric layer 70 in the second direction Y is greater than the length of the pressure generating chamber 12 in the second direction Y. Therefore, the piezoelectric layer 70 is provided to the outside of the pressure generating chamber 12 in the second direction Y of the pressure generating chamber 12.

The end portion of the piezoelectric layer 70 at the ink supply path side is positioned closer to the outside than the end portion of the first electrode 60 in the second direction Y of the pressure generating chamber 12. In other words, the end portion of the first electrode 60 is covered by the piezoelectric layer 70. The end portion of the nozzle opening 21 side of the piezoelectric layer 70 is positioned closer to the inside (the pressure generating chamber 12 side) than the end portion of the first electrode 60, and the end portion of the nozzle opening 21 side of the first electrode 60 is not covered by the piezoelectric layer 70.

The piezoelectric layer 70 is formed of a piezoelectric material, which is an oxide which is formed on the first electrode 60 and has a polarized structure. For example, the piezoelectric layer 70 may be formed of a perovskite-type oxide indicated by general formula $ABO_3$, and it is possible to use a lead-based piezoelectric material containing lead or a non-lead-based piezoelectric material not containing lead, or the like.

A concave portion 71 corresponding to the partitioning walls is formed in the piezoelectric layer 70. The width of the concave portion 71 in the first direction X is approximately the same as or wider than the width of the partitioning walls in the first direction X. Accordingly, since the rigidity of the portion (the so-called arm portion of the diaphragm 50) which faces the end portion in the second direction Y of the pressure generating chamber 12 of the diaphragm 50 is suppressed, it is possible to favorably displace the piezoelectric actuator 300.

The second electrode 80 is provided on the opposite surface side of the piezoelectric layer 70 from the first electrode 60, and configures a common electrode which is common to a plurality of functional units. The second electrode 80 may or may not be provided on the inner surface of the concave portion 71, that is, the inner surface of the concave portion 71 side of the piezoelectric layer 70.

In the piezoelectric actuator 300 which is formed of the first electrode 60, the piezoelectric layer 70, and the second electrode 80, a displacement is generated by applying a voltage across the first electrode 60 and the second electrode 80. In other words, by applying a voltage across both of the electrodes, piezoelectric strain arises in the piezoelectric layer 70 which is interposed between the first electrode 60 and the second electrode 80. The portion in which the piezoelectric strain arises in the piezoelectric layer 70 when a voltage is applied across both of the electrodes will be referred to as the functional unit. In contrast, the portion in which the piezoelectric strain does not arise in the piezoelectric layer 70 will be referred to as a non-functional unit. In the functional unit in which the piezoelectric strain arises in the piezoelectric layer 70, the portion which faces the pressure generating chamber 12 will be referred to as a flexible portion, and the portion outside of the pressure generating chamber 12 will be referred to as a non-flexible portion.

In the present embodiment, the first electrode 60, the piezoelectric layer 70, and the second electrode 80 are all provided continuously in the second direction Y to the outside of the pressure generating chamber 12. In other words, the functional unit is provided continuously to the outside of the pressure generating chamber 12. Therefore, the portion of the piezoelectric actuator 300 in the functional unit which faces the pressure generating chamber 12 is the flexible portion, and the portion outside of the pressure generating chamber 12 is the non-flexible portion.

An individual wiring 91, which is lead-out wiring, is led out from the first electrode 60 of the piezoelectric actuator 300. In the present embodiment, two rows of the piezoelectric actuators 300 (the functional units) which are juxtaposed in the first direction X are provided adjacent to each other in the second direction Y, and the individual wiring 91 which is lead out from the first electrode 60 of the piezoelectric actuator 300 of one row will be referred to as a first individual wiring 91A. The individual wiring 91 which is lead out from the first electrode 60 of the piezoelectric actuator 300 of the other row will be referred to as a second individual wiring 91B. In the present embodiment, the first individual wirings 91A and the second individual wirings 91B are lead out between the piezoelectric actuators 300 of the respective two rows, and the end portions of the opposite side from the first electrodes 60 are juxtaposed on a straight line along the first direction X. Note that, in the present embodiment, the piezoelectric actuators 300 of one row are the piezoelectric actuators 300 which are provided on the Y1 side (illustrated in FIG. 2) in the second direction Y, and will also be referred to as first drive elements 300A which cause ink droplets to be ejected from the nozzle openings 21 of the nozzle row (a first nozzle row) of the nozzle openings 21 which are juxtaposed in the first direction X. The piezoelectric actuators 300 of the other row are the piezoelectric actuators 300 which are provided on the Y2 side (illustrated in FIG. 2) in the second direction Y, and will also be referred to as second drive elements 300B which cause ink droplets to be ejected from the nozzle openings 21 of the nozzle row (a second nozzle row) of the nozzle openings 21 which are juxtaposed in the first direction X.

A common wiring 92, which is a lead-out wiring, is led out from the second electrode 80. In the present embodiment, the common wiring 92 which is led out from the second electrode 80 of the first drive element 300A will be referred to as a first common wiring 92A. The common wiring 92 which is led out from the second electrode 80 of the second drive element 300B will be referred to as a second common wiring 92B. In the present embodiment, the first common wiring 92A is led out from the X1 side, which is one side in the first direction X, and the first common wiring 92A is provided to extend to the X1 side on a straight line in which the first individual wirings 91A and the second individual wirings 91B are juxtaposed. The second common wiring 92B is led out from the X2 side, which is the opposite side from the first common wiring 92A in the first direction X, and the second common wiring 92B is provided to extend to the X2 side on a straight line in which the first individual wirings 91A and the second individual wirings 91B are juxtaposed. In other words, the first common wiring 92A and the second common wiring 92B are provided independently on the diaphragms 50 of the flow path forming substrate 10 without being connected to each other.

In this manner, by providing the first common wiring 92A and the second common wiring 92B individually independent of each other without electrically connecting the first and second common wirings 92A and 92B, even when there is a fluctuation in the number of the piezoelectric actuators 300 (the first drive elements) of the X1 side which are driven at the same time, it is possible to suppress the rounding of a drive waveform which drives the piezoelectric actuators 300 (the second drive elements) of the X2 side to always drive the second drive elements under the same conditions, it is possible to suppress variation in the ejection properties of the ink droplets, and it is possible to realize high quality printing. In other words, if the first common wiring 92A is electrically connected to the second common wiring 92B, when all of the first drive elements are driven at the same time, the drive waveform which drives the second drive elements is rounded, and so-called crosstalk is generated in which variation arises in the driving of the second drive elements, and variation arises in the ejection properties of the ink droplets. In the present embodiment, since the first common wiring 92A is not electrically connected to the second common wiring 92B, it is possible to suppress the generation of crosstalk and to suppress the variation in the ejection properties of the ink droplets.

In this manner, a common flexible cable 120 is connected to the end portions of the first individual wirings 91A, the first common wiring 92A, the second individual wirings 91B, and the second common wiring 92B, the end portions extending to the opposite side from the end portions which are connected to the piezoelectric actuators 300. In the present embodiment, the end portions of the first individual wirings 91A, the first common wiring 92A, the second individual wirings 91B, and the second common wiring 92B which are connected to the flexible cable 120 will be respectively referred to as first individual terminals 91*a*, a first common terminal 92*a*, second individual terminals 91*b*, and a second common terminal 92*b*, and the first individual terminals 91*a*, the first common terminal 92*a*, the second individual terminals 91*b*, and the second common terminal 92*b* form connection regions to which the flexible cable 120 is connected. The first individual terminals 91*a*, the first common terminal 92*a*, the second individual terminals 91*b*, and the second common terminal 92*b* which are a plurality of connection regions are juxtaposed on a straight line along the first direction X on the diaphragms 50, as described above. Therefore, it is easy to connect the single common flexible cable 120 to the first individual terminals 91*a*, the first common terminal 92*a*, the second individual terminals 91*b*, and the second common terminal 92*b*.

The flexible cable 120 is a flexible wiring substrate, and in the present embodiment, the drive circuit 121, which is a semiconductor element, is installed thereon. As illustrated in FIG. 6, the flexible cable 120 is provided with individual connection wirings 122 which are connected to the individual wirings 91, and common connection wirings 123 which are connected to the common wirings 92. Here, the individual connection wirings 122 include first individual connection wirings 122A which are connected to the first individual wirings 91A, and second individual connection wirings 122B which are connected to the second individual wirings 91B. The drive circuit 121 is connected to the other end portions of the opposite side of the first individual connection wirings 122A and the second individual connection wirings 122B from the one end portions which are connected to the first individual wirings 91A and the second individual wirings 91B. Input wirings 124 are provided in the flexible cable 120 with one end connected to the drive circuit 121, and the input wirings 124 are provided to extend to the end portion of the opposite side from the first individual connection wirings 122A and the second individual connection wirings 122B. For example, the input wirings 124 are for supplying head control signals such as setting signals including a drive signal (COM), a clock signal (CLK), a latch signal (LAT), a change signal (CH), pixel data (SI), and setting data (SP) to the drive circuit 121. For example, on the inside portion of the drive circuit 121, a switching element such as a transmission gate is provided for each of the piezoelectric actuators 300, and drive signals are supplied to the piezoelectric actuators 300 at a desired timing by causing the switching elements to open and close based on the head control signals which are input by the input wiring 124.

The common connection wirings 123 which are provided in the flexible cable 120 include a first common connection wiring 123A which is connected to the first common wiring 92A, and a second common connection wiring 123B which is connected to the second common wiring 92B. The first common connection wiring 123A and the second common connection wiring 123B are provided continuously to span from the one end portion to the other end portion of the flexible cable 120 without either being connected to the drive circuit 121. A voltage (a bias voltage: vbs) is applied to the second electrodes 80 from the first common connection wiring 123A and the second common connection wiring 123B via the first common wiring 92A and the second common wiring 92B.

The first common connection wiring 123A and the second common connection wiring 123B are provided independently on the flexible cable 120 without being connected to each other. Therefore, it is possible to suppress crosstalk without the first common connection wiring 123A and the first common wiring 92A which is connected thereto being electrically connected to the second common connection wiring 123B and the second common wiring 92B which is connected thereto. Incidentally, as described above, even when the first common wiring 92A and the second common wiring 92B are not connected to each other on the diaphragm 50 where the flexible cable 120 is installed, when the first common connection wiring 123A and the second common connection wiring 123B on the flexible cable 120 are electrically connected to each other, the first common wiring 92A conducts with the second common wiring 92B and crosstalk is generated.

The first individual terminals 91*a*, the first common terminal 92*a*, the second individual terminals 91*b*, and the second common terminal 92*b* are juxtaposed on a straight line along the first direction X on the diaphragms 50, as described above. Therefore, it is possible to obtain a reduction in the size of the recording head 2 by reducing the space in which the single common flexible cable 120 is connected to the first individual terminals 91*a*, the first common terminal 92*a*, the second individual terminals 91*b*, and the second common terminal 92*b*. Since the single common flexible cable 120 is connected to the first drive elements 300A and the second drive elements 300B, it is possible to reduce costs by reducing the number of components.

A protective substrate 30 which is approximately the same size as the flow path forming substrate 10 is joined to the surface of a piezoelectric actuator 300 side of the flow path forming substrate 10. The protective substrate 30 includes holding portions 31 which are spaces for protecting the piezoelectric actuators 300. Two of the holding portions 31 are formed to line up adjacent in the second direction Y between the rows of the piezoelectric actuators 300 which are juxtaposed in the first direction X. A through hole 32 which penetrates the protective substrate 30 in the third direction Z is provided in the protective substrate 30 between the two holding portions 31 which are juxtaposed in the second direction Y. The end portions of the first individual wirings 91A, the first common wirings 92A, the second individual connection wirings 91B and the second common wiring 92B which are lead out from the electrodes of the piezoelectric actuators 300 are provided to extend to be exposed within the through hole 32, and the first individual wirings 91A, the first common wirings 92A, the second individual connection wirings 91B and the second common wiring 92B are electrically connected to the first individual connection wirings 122A, the first common connection wiring 123A, the second individual connection wirings 122B and the second common connection wiring 123B of the flexible cable 120 on the inside of the through hole 32. Note that, the method by which the first individual wirings 91A, the first common wirings 92A, the second individual connection wirings 91B and the second common wiring 92B are electrically connected to the first individual connection wirings 122A, the first common connection wiring 123A, the second individual connection wirings 122B, and the second common connection wiring 123B of the flexible cable 120 is not particular limited. For example, connection methods include brazing and soldering, eutectic bonding, welding, a conductive adhesive containing conductive particles (ACP, ACF), and a non-conductive adhesive (NCP, NCF).

A case member 40 which, together with the flow path forming substrate 10, forms the manifold 100 which communicates with the plurality of pressure generating chambers 12 by partitioning is fixed onto the protective substrate 30. The case member 40 is substantially the same shape as the communicating plate 15 described above in plan view, and is joined to the protecting member 30 and the communicating plate 15 described above. Specifically, the case member 40 includes a concave portion 41 on the protective substrate 30 side. The concave portion 41 is of a depth in which the flow path forming substrate 10 and the protective substrate 30 are housed. The concave portion 41 has a wider opening area than the surface of the protective substrate 30 that is joined to the flow path forming substrate 10. The opening surface of the nozzle plate 20 side of the concave portion 41 is sealed by the communicating plate 15 in a state in which the flow path forming substrate 10 and the like are housed in the concave portion 41. Accordingly, in the outer peripheral portion of the flow path forming substrate 10, a third manifold portion 42 is formed by being partitioned by the case member 40 and the flow path forming substrate 10. The manifold 100 of the present embodiment is configured by the first manifold portion 17 and the second manifold portion 18, which are provided in the communicating plate 15, and the third manifold portion 42 which is formed by being partitioned by the case member 40 and the flow path forming substrate 10. The manifold 100 is provided continuously across the first direction X which is the juxtaposition direction of the pressure generating chambers 12, and the supply communicating paths 19 which communicate the pressure generating chambers 12 with the manifold 100 are juxtaposed in the first direction X.

A compliance substrate 45 is provided on the surface of the communicating plate 15 to which the first manifold portion 17 and the second manifold portion 18 are open. The compliance substrate 45 seals the opening of the liquid ejecting surface 20*a* side of the first manifold portion 17 and the second manifold portion 18. In the present embodiment, the compliance substrate 45 includes a sealing film 46 and a fixing substrate 47. The sealing film 46 is formed of a flexible thin film, and the fixing substrate 47 is formed of a hard material such as a metal. Since the region of the fixing substrate 47 which faces the manifold 100 forms an opening portion 48 which is fully removed in the thickness direction, one surface of the manifold 100 forms a compliance portion 49 which is a flexible portion which is sealed only by the flexible sealing film 46.

Note that, the case member 40 is provided with inlet paths 44 which communicate with the manifolds 100 and supply the ink to the manifolds 100. The case member 40 is provided with a connecting port 43 which communicates with the through hole 32 of the protective substrate 30 and through which the flexible cable 120 is inserted.

In the recording head 2, when the ink is ejected, the ink is taken in from the inlet paths 44, and the inner portions of the flow paths from the manifolds 100 to the nozzle openings 21 are filled with the ink. Subsequently, the diaphragms 50 are subjected to flexure deformation together with the piezoelectric actuators 300 due to voltages being applied to the piezoelectric actuators 300 corresponding to the pressure generating chambers 12 according to the signal from the drive circuit 121. Accordingly, the pressure within the pressure generating chamber 12 rises and an ink droplet is ejected from the predetermined nozzle opening 21.

A plurality of the recording heads 2 are fixed to a holding member to configure an ink jet recording head unit (hereinafter also simply referred to as a head unit).

Figure 7:
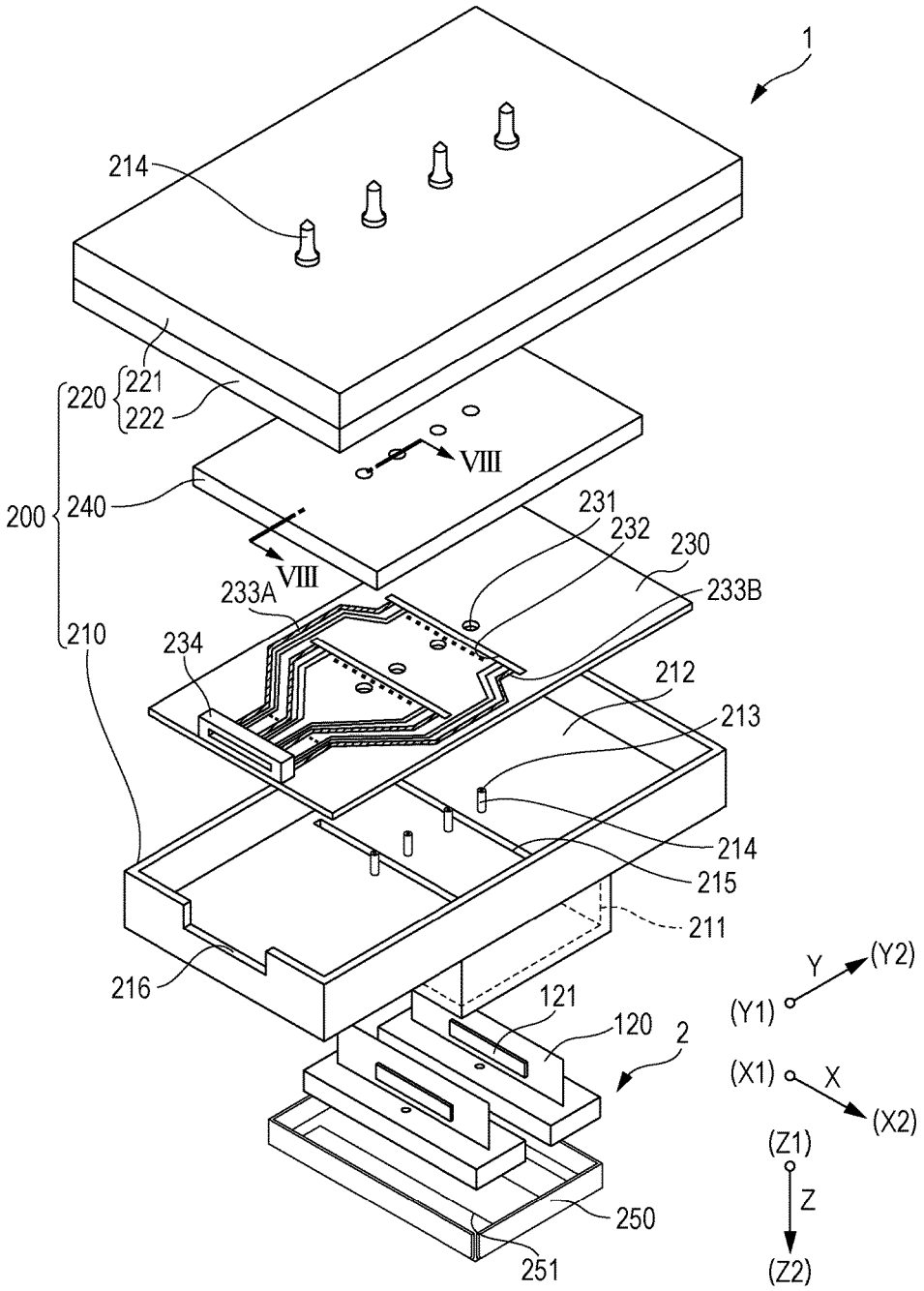
FIG. 7 is an exploded perspective diagram of a head unit according to the first embodiment of the invention.
Figure 8:
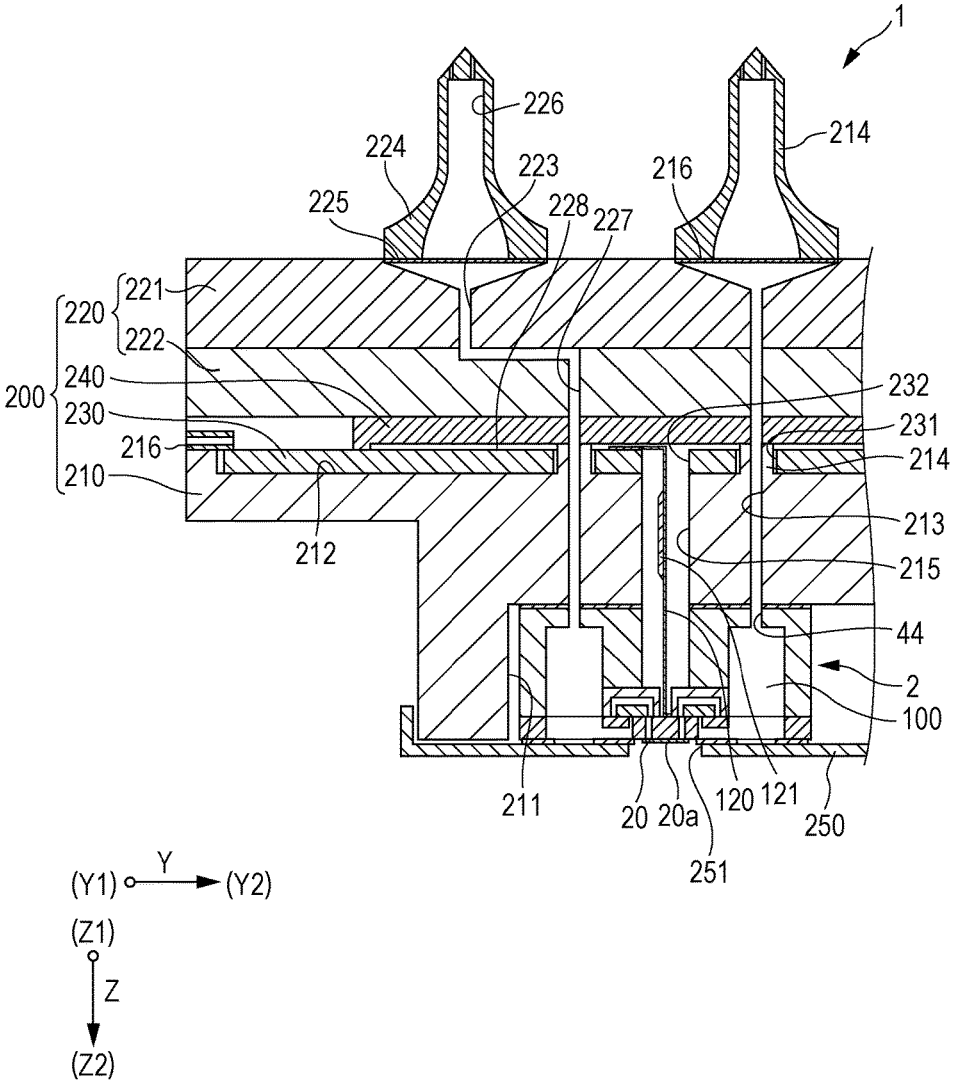
FIG. 8 is a sectional diagram of the head unit according to the first embodiment of the invention.
Figure 9:
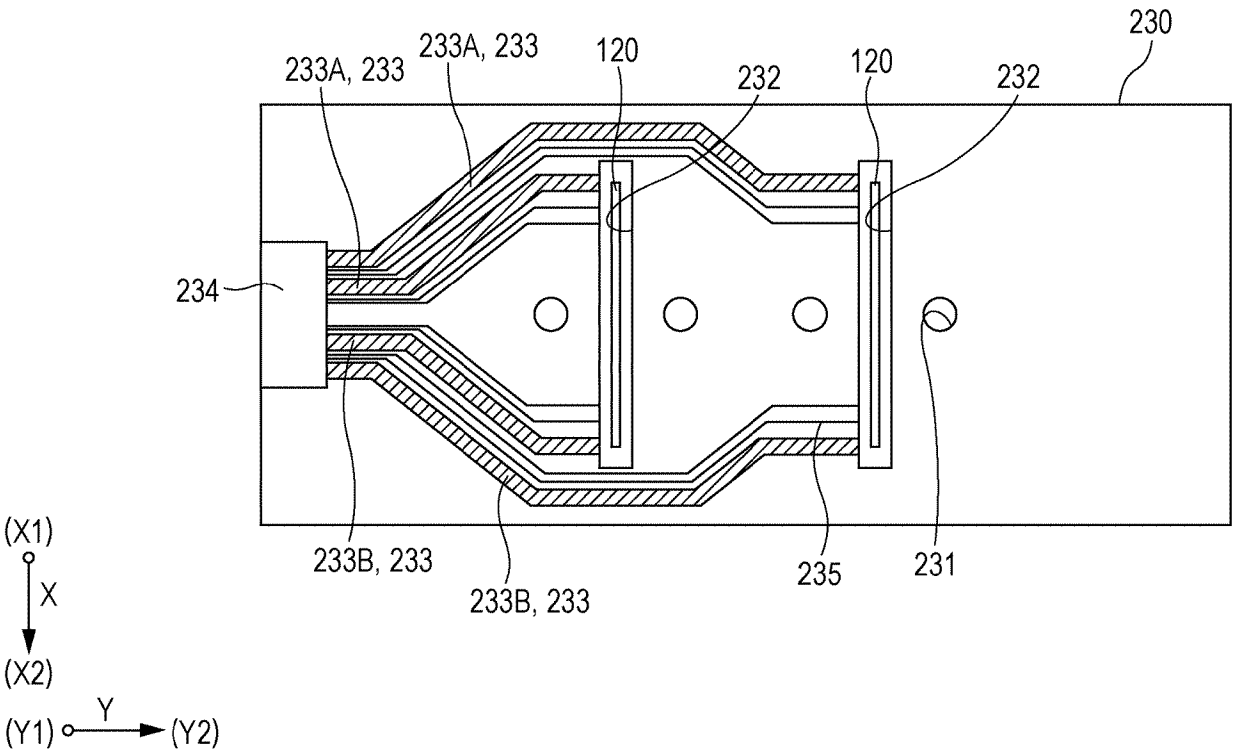
FIG. 9 is a plan view of an intermediate substrate according to the first embodiment of the invention.

Here, detailed description will be given of an example of the head unit of the present embodiment, with reference to FIGS. 7 to 9. Note that, FIG. 7 is an exploded perspective view of an ink jet recording head unit (an example of the liquid ejecting head unit according to the first embodiment of the invention), FIG. 8 is a sectional view of the ink jet recording head unit, and FIG. 9 is a plan view of the intermediate substrate. Note that, the directions in the head unit 1 will be described based on the first direction X, the second direction Y, and the third direction Z of the recording head 2 which is held in a head unit 1.

As illustrated in the drawings, the head unit 1 is provided with a plurality of the recording heads 2, an intermediate substrate 230, and a holding member 200. The flexible cables 120 of the plurality of recording heads 2 are connected to the intermediate substrate 230, the plurality of recording heads 2 are fixed to the holding member 200, and the intermediate substrate 230 is held on the inside portion of the holding member 200.

The holding member 200 is provided with a head holding member 210, a flow path member 220, and a sealing member 240. The head holding member 210 is provided on one surface side (an ejection-target medium side) of the holding member 200 in the third direction Z and holds the recording head 2, the flow path member 220 is provided on the other surface side of the head holding member 210 in the third direction Z and holds the intermediate substrate 230 between the head holding member 210 and the flow path member 220, and the sealing member 240 is provided between the head holding member 210 and the flow path member 220.

A head holding portion 211 is provided on the one surface side (the ejection-target medium side) of the head holding member 210 in the third direction Z, and the recording heads 2 are housed and held in the inner portion of the head holding member 210. The head holding portion 211 has an open concave shape on the surface of the ejection-target medium side of the head holding member 210. In the present embodiment, the head holding portion 211 is provided at a size in which the two recording heads 2 can be housed. In the present embodiment, the opposite side of the case member 40 of the recording head 2 from the liquid ejecting surface 20*a* is fixed to the bottom surface of the head holding portion 211.

A cover head 250 which covers the opening of the head holding portion 211 is provided on the surface of the head holding portion 211 side of the head holding member 210. The cover head 250 is formed of a plate-shaped member which includes an exposed opening portion 251 which exposes the liquid ejecting surface 20*a*. Two of the exposed opening portions 251 are formed to independently expose the liquid ejecting surfaces 20*a* of the recording heads 2. In the present embodiment, the exposed opening portion 251 has a size which exposes the nozzle plate 20, and is joined to the opposite surface side of the compliance substrate 45 of the recording head 2 from the communicating plate 15. In the present embodiment, the cover head 250 is provided such that the end portion thereof is bent from the liquid ejecting surface 20*a* side so as to cover the side surface (the surface intersecting the liquid ejecting surface 20*a*) of the head holding member 210.

An intermediate substrate holding portion 212 is provided on the other surface side (the second head holding member side) of the head holding member 210 in the third direction Z, and the intermediate substrate 230 is housed in the inner portion of the head holding member 210. The intermediate substrate 230 is disposed to face the third direction Z on the inside of the intermediate substrate holding portion 212. In the present embodiment, the intermediate substrate 230 is formed of a rigid substrate, and is housed within the intermediate substrate holding portion 212 such that the intermediate substrate 230 becomes a plane containing a first direction X component and a second direction Y component. Note that, the intermediate substrate 230 is not limited to being a rigid substrate, and, for example, may be a flexible substrate such as an FPC or an FFC.

The head holding member 210 is provided with connecting flow paths 213 for supplying the ink which is supplied from the flow path member 220 to the recording heads 2. In the present embodiment, the connecting flow paths 213 are provided independently for each of the inlet paths 44 of the recording heads 2. In other words, since two of the inlet paths 44 are provided in one of the recording heads 2, a total of four of the connecting flow paths 213 are provided in relation to the two recording heads 2. One end of the connecting flow path 213 is provided to be open to the end surface of a first protruding portion 214 which is provided within the intermediate substrate holding portion 212 to protrude in the third direction Z. The other end of the connecting flow path 213 is provided to be open to the bottom surface of the head holding portion 211, and the connecting flow path 213 is provided along a straight line in the third direction Z.

In the head holding member 210, a flexible cable insertion hole 215 for inserting the flexible cable 120 is provided between two of the connecting flow paths 213 which are provided for each one of the recording heads 2 in the first direction X.

As illustrated in FIG. 9, a first insertion hole 231 into which the first protruding portion 214 is inserted, and second insertion holes 232 into which the flexible cables 120 are inserted are provided in the intermediate substrate 230. The flexible cables 120 which are inserted through the second insertion holes 232 are connected to the intermediate substrate 230 on the surface of the opposite side of the intermediate substrate 230 from the recording head 2. Note that, the method by which the flexible cables 120 are connected to the intermediate substrate 230 are not particularly limited, and the connection methods include brazing and soldering, eutectic bonding, welding, a conductive adhesive containing conductive particles (ACP, ACF), and a non-conductive adhesive (NCP, NCF). In the present embodiment, in the head unit 1, the two flexible cables 120 are connected to the common single intermediate substrate 230 since two of the recording heads 2 are held. Therefore, it is possible to reduce the size and it is possible to reduce costs by reducing the number of components in comparison with a configuration in which the intermediate substrate 230 is provided for each of the flexible cables 120 of the recording heads 2.

Common intermediate wirings 233 which are connected to the common connection wirings 123 of the flexible cables 120 are provided in the intermediate substrate 230. Specifically, the common intermediate wirings 233 include first common intermediate wirings 233A which are connected to the first common connection wirings 123A of the flexible cables 120, and second common intermediate wirings 233B which are connected to the second common connection wirings 123B. In the present embodiment, since the two flexible cables 120 are connected in common to the single intermediate substrate 230, the first common intermediate wiring 233A and the second intermediate substrate 233B are provided on the intermediate substrate 230 for each of the flexible cables 120. In other words, two of the first common intermediate wirings 233A and two of the second common intermediate wirings 233B are provided on the intermediate substrate 230. The first common intermediate wirings 233A and the second common intermediate wirings 233B are provided independently on the intermediate substrate 230 without being electrically connected to each other. Therefore, it is possible to suppress crosstalk of the piezoelectric actuators 300 without the first common intermediate wirings 123A and the first common wirings 92A of the flexible cables 120 which are respectively connected to the first common intermediate wirings 233A and the second common intermediate wirings 233B of the intermediate substrate 230 being electrically connected to the second common connection wirings 123B and the second common wirings 92B.

A connector 234 is provided on the one end side in the second direction Y of the intermediate substrate 230. As illustrated in FIGS. 7 and 8, in the present embodiment, the connector 234 is fixed to the Y1 side (the opposite surface side from the head holding member 210) of the intermediate substrate 230. In the head holding member 210, a connection hole 216 which communicates the intermediate substrate holding portion 212 with the outside is provided on the side wall mutually facing the connector 234, that is, the side wall of the Y1 side, and the connector 234 is exposed to the outside from the side surface of the Y1 side by the connection hole 216. An outer wiring substrate 410 (described later in detail) is connected to the connector 234 from the outside of the head unit 1. In other words, the outer wiring substrate 410 is lead out to the Y1 side in the second direction Y of the head unit 1. Note that, individual intermediate wirings 235 which connect the input wirings 124 of the flexible cables 120 to the connector 234 are provided on the intermediate substrate 230. Electronic components such as capacitors, transistors, and integrated circuits may be installed on the intermediate substrate 230.

The flow path member 220 is fixed to the surface of the opposite side of the head holding member 210 from the recording heads 2. The flow path member 220 is provided with a first flow path member 221 and a second flow path member 222 which are laminated in the third direction Z. Note that, the flow path member 220 of the present embodiment is configured by laminating the first flow path member 221 and the second flow path member 222; however, the embodiment is not limited thereto, and a configuration may be adopted in which the flow path member 220 is a single member, or a laminate of three or more members. The lamination direction of a plurality of members which form the flow path member 220 is also not limited in particular, and may also be the first direction X or the second direction Y.

The first flow path member 221 includes a first flow path 223 which is provided to penetrate the first flow path member 221 in the third direction Z. A needle-shaped connection member 224 is fixed to the opening portion of the opposite side of the first flow path 223 from the second flow path member 222 via a filter 225. The connection member 224 is connected to a liquid storage unit such as an ink tank or an ink cartridge in which the ink (the liquid) is held, and the filter 225 is for removing bubbles or foreign matter contained in the ink.

The connection member 224 includes a through hole 226 which communicates with the first flow path 223. Due to the connection member 224 being connected to the liquid storage unit, the ink within the liquid storage unit is supplied to the first flow path 223 via the through hole 226 of the connection member 224. Note that, a liquid storage unit such as an ink cartridge may be directly connected to the connection member 224, or, a liquid storage unit such as an ink tank may be connected to the connection member 224 via a supply tube such as a tube.

The second flow path member 222 includes a second flow path 227 which is provided to penetrate the second flow path member 222 in the third direction Z. The second flow path 227 communicates with the connecting flow path 213 of the head holding member 210 on the opposite side from the first flow path member 221.

A communicating flow path 228 which communicates the first flow path 223 with the second flow path 227 is provided between the first flow path member 221 and the second flow path member 222. The communicating flow path 228 is provided parallel to the in-plane directions which orthogonally intersect the third direction Z, that is, parallel to a plane containing a first direction X component and a second direction Y component. The communicating flow path 228 is formed by sealing a groove portion which is provided in the second flow path 222 with the first flow path member 221. By connecting the first flow path 223 to the second flow path 227 using the communicating flow path 228, it becomes possible to dispose the first flow path 223 and the second flow path 227 in positions which do not overlap as viewed from the third direction Z in plan view. Therefore, it is possible to use an ink cartridge which is larger than the recording heads 2, and it is possible to increase the degree of freedom in the design of the flow path.

The second flow path 227 of the flow path member 220 is connected to the connecting flow path 213 of the head holding member 210 via the sealing member 240. The sealing member 240 is a plate-shaped member which is formed of an elastic material such as rubber or an elastomer.

Figure 10:
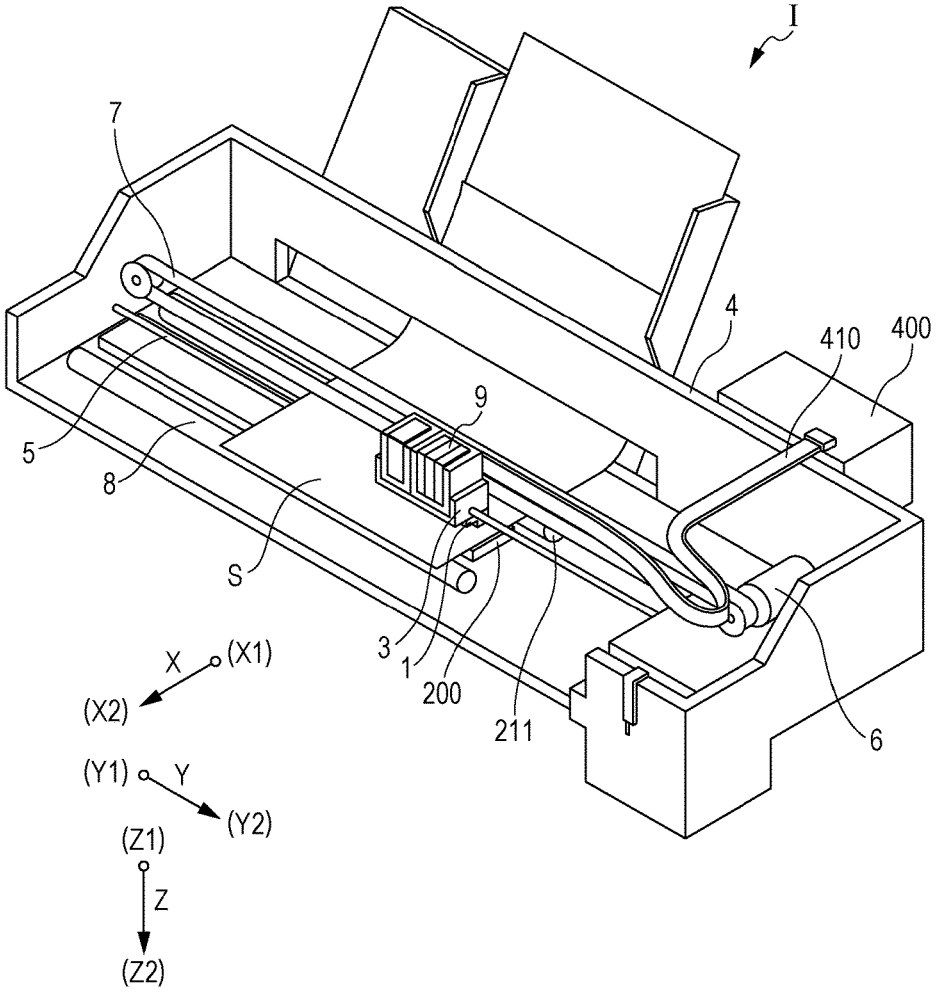
FIG. 10 is a schematic diagram of a recording apparatus according to the first embodiment of the invention.
Figure 11:
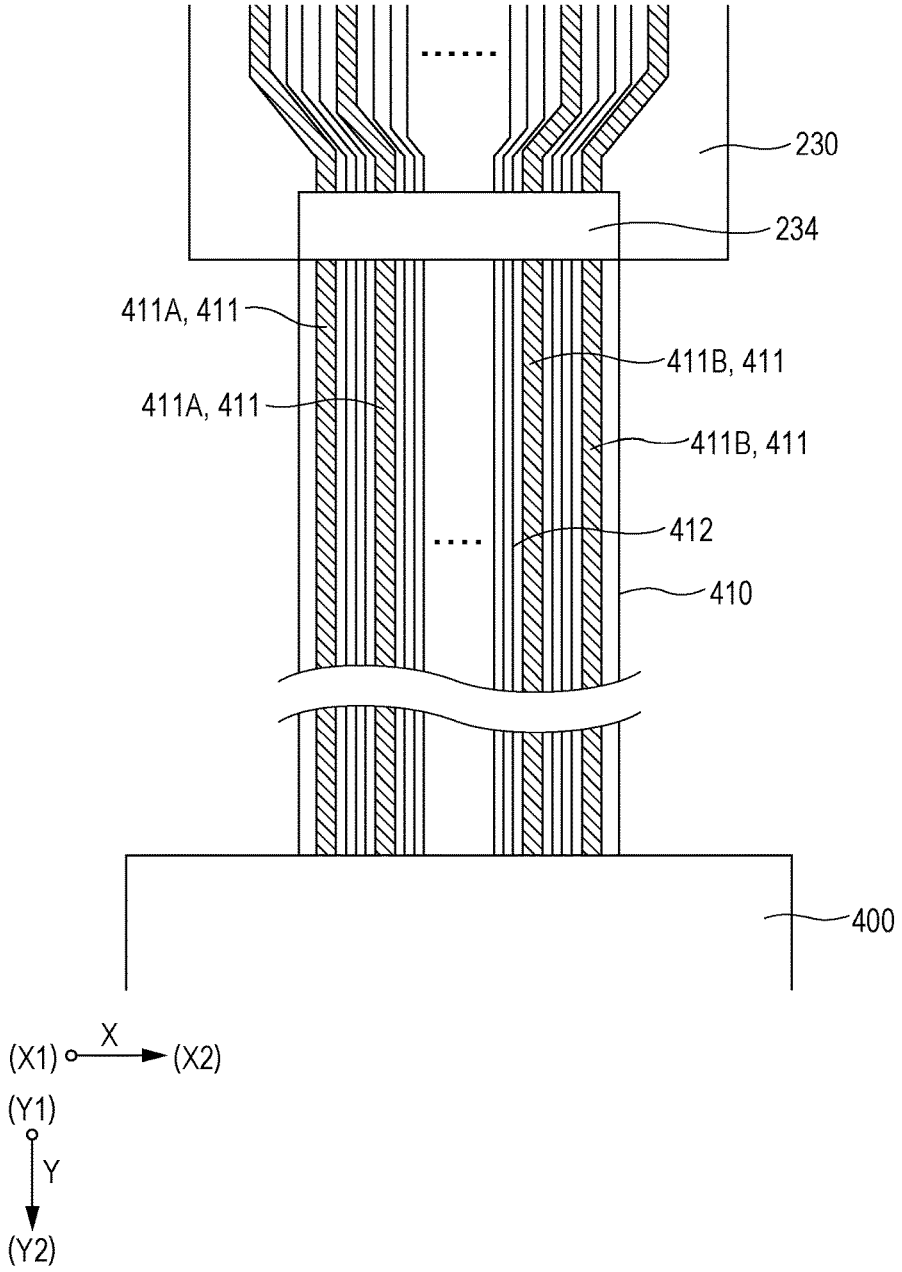
FIG. 11 is a plan view of an outer wiring according to the first embodiment of the invention.

The head unit 1 is installed in an ink jet recording apparatus I. FIG. 10 is a schematic diagram illustrating an example of an ink jet recording apparatus of the present embodiment, and FIG. 11 is a plan view of an outer wiring illustrating a connected state between a head unit and a control device.

In the ink jet recording apparatus I illustrated in FIG. 10, the head unit 1 is provided such that a plurality of ink cartridges 9 which form an ink supply unit can be attached and detached, and a carriage 3 having the head unit 1 installed thereon is provided to be capable of moving freely in an axial direction along a carriage shaft 5 which is attached to an apparatus main body 4. In the present embodiment, four of the ink cartridges 9 are mounted to the head unit 1, and four different inks are ejected from the two recording heads 2.

The carriage 3 to which the head unit 1 is mounted is moved along the carriage shaft 5 by the drive force of a drive motor 6 being transmitted to the carriage 3 via a plurality of gears and a timing belt 7 (not shown). Meanwhile, the apparatus main body 4 is provided with a transport roller 8 as a transport unit, and a recording sheet S, which is a recording medium such as paper, is transported by the transport roller 8. Note that, the transport unit which transports the recording sheet S is not limited to being a transport roller, and may be a belt, a drum, or the like.

A control device 400 which is a control unit which performs the control of the ink jet recording apparatus I is installed in the apparatus main body 4, and the control device 400 is connected to the intermediate substrate 230 of the head unit 1 via the outer wiring substrate 410. In the present embodiment, the intermediate substrate 230 of the head unit 1 moves reciprocally in the second direction Y relative to the control device 400 due to the carriage 3, and the outer wiring substrate 410 follows the reciprocal movement of the intermediate substrate 230 in the second direction Y.

Here, as illustrated in FIG. 11, the outer wiring substrate 410 includes common outer wirings 411 and individual outer wirings 412. The common outer wirings 411 are connected to the common intermediate wirings 233 of the intermediate substrate 230, and the individual outer wirings 412 are connected to the individual intermediate wirings 235. In the present embodiment, the common outer wirings 411 include first common outer wirings 411A which are connected to the first common intermediate wirings 233A, and second common outer wirings 411B which are connected to the second common intermediate wirings 233B. In the present embodiment, the outer wiring substrate 410 is provided with two of the first common outer wirings 411A and two of the second common outer wirings 411B to match the number of the first common intermediate wirings 233A and the second common intermediate wirings 233B of the intermediate substrate 230.

The first common outer wirings 411A and the second common outer wirings 411B are independently provided on the outer wiring substrate 410 without being connected to each other. In this manner, by providing the first common outer wirings 411A and the second common outer wirings 411B independently, it is possible to prevent the first common intermediate wirings 233A, the first common connection wirings 123A, and the first common wirings 92A which are connected to the first common outer wirings 411A from being connected to the second common intermediate wirings 233B, the second common connection wirings 123B, and the second common wirings 92B which are connected to the second common outer wirings 411B, and it is possible to suppress crosstalk between the first drive elements 300A and the second drive elements 300B.

Note that, the outer wiring substrate 410 is provided with the individual outer wirings 412 which are connected to the individual intermediate wirings 235 of the intermediate substrate 230, and a head control signal or the like is supplied from the individual outer wirings 412 to the drive circuit 121 via the individual intermediate wirings 235 of the intermediate substrate 230 and the input wirings 124 of the flexible cable 120.

Second Embodiment

Figure 12:
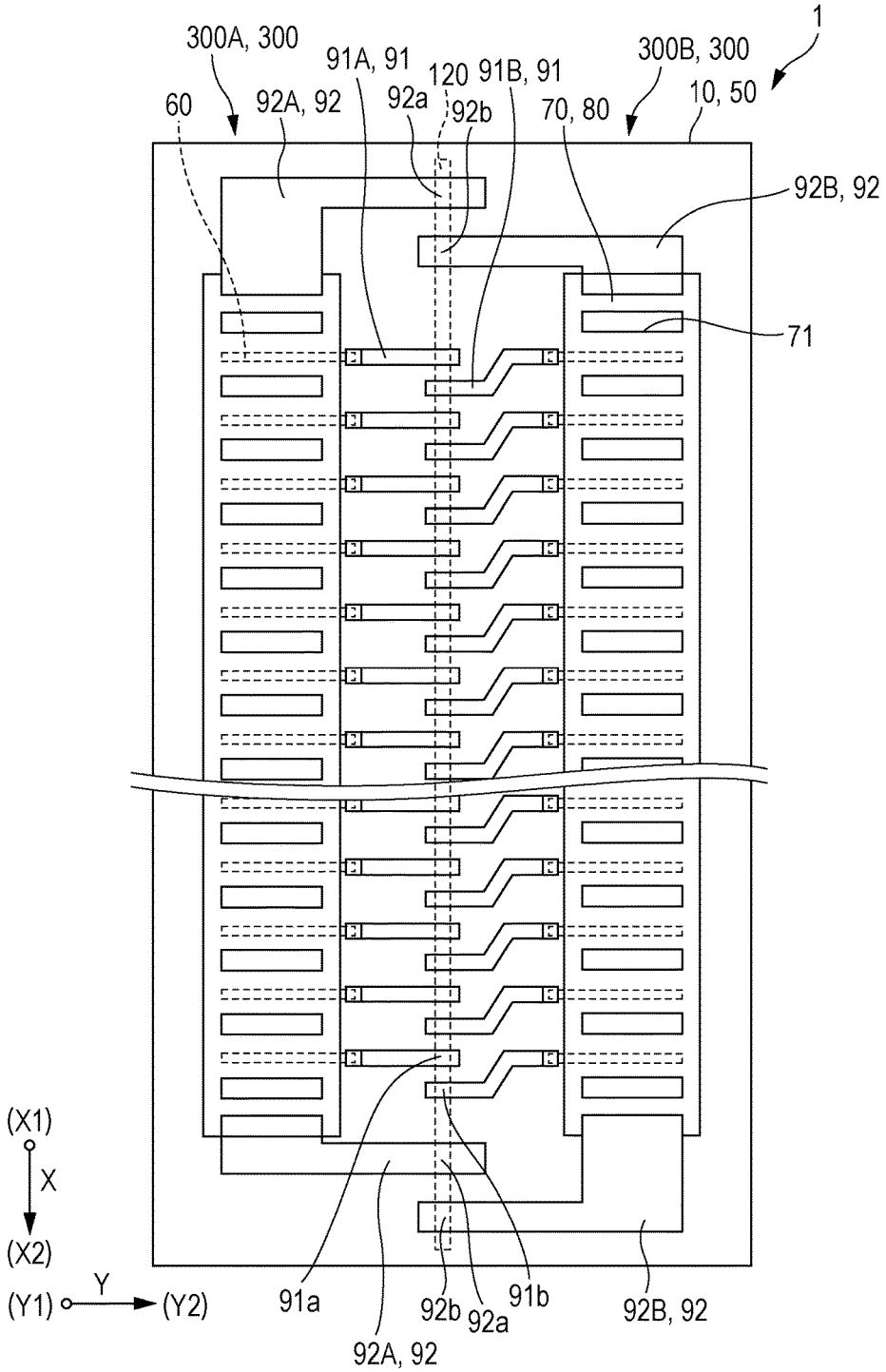
FIG. 12 is a plan view of the main components of a recording head according to a second embodiment of the invention.

FIG. 12 is a plan view of the main components of a recording head according to the second embodiment of the invention. Note that, members which are the same as those in the embodiment described above are assigned the same reference numerals, and redundant description will be omitted.

As illustrated in FIG. 12, the first common wirings 92A are led out from both sides (X1 and X2) in the first direction X in relation to one row of the piezoelectric actuators 300 which serve as the first drive elements 300A, and the second common wirings 92B are led out from both sides (X1 and X2) in the first direction X in relation to the other row of the piezoelectric actuators 300 which serve as the second drive elements 300B.

In other words, the first common wirings 92A are provided on both the X1 side and the X2 side of the second electrode 80 of the first drive elements 300A in the first direction X. The end portions of the first common wirings 92A are provided to extend at the X1 side and the X2 side of the first individual terminals 91*a* and the second individual terminals 91*b* which are juxtaposed on a straight line along the first direction X, and the end portions which are provided to extend from the first common wirings 92A are the first common terminals 92*a*. In other words, in the present embodiment, two of the first common terminals 92*a* are provided.

Similarly, the second common wirings 92B are provided on both the X1 side and the X2 side of the second electrode 80 of the second drive elements 300B in the first direction X. The end portions of the second common wirings 92B are provided to extend at the X1 side and the X2 side of the first individual terminals 91*a* and the second individual terminals 91*b* which are juxtaposed on a straight line along the first direction X. In other words, in the present embodiment, two of the second common terminals 92*b* are provided.

The first common wirings 92A and the second common wirings 92B which are formed on the diaphragms 50 of the flow path forming substrate 10 are provided independently without being connected to each other. Accordingly, it is possible to suppress the generation of crosstalk between the first drive elements 300A and the second drive elements 300B.

Since a voltage (vbs) is applied to the row of piezoelectric actuators 300 (the first drive elements 300A) of the Y1 side from both sides in the first direction X via the first common wirings 92A, it is possible to suppress a reduction in the voltage which is applied to the second electrode 80 of the plurality of piezoelectric actuators 300 which are juxtaposed in the first direction X. Incidentally, for example, when the first common wiring 92A is only provided on one side (the X1 side) in the juxtaposition direction (the first direction X) of the plurality of piezoelectric actuators 300, a difference arises in the voltages which are applied to the piezoelectric actuators 300 of the X1 side and the piezoelectric actuators 300 of the X2 side (a voltage drop). Therefore, the plurality of piezoelectric actuators 300 may not be driven at the same voltage, variation will arise in the displacement amounts, and printing faults caused by variation in the ejection properties of the ink droplets will occur. In contrast, when the thickness of the second electrode 80 is increased in order to decrease the electrical resistance value of the second electrode 80, the second electrode 80 impedes the displacement of the piezoelectric actuators 300, and the displacement amounts of the piezoelectric actuators 300 are reduced. In the present embodiment, by providing the first common wirings 92A on both sides of the plurality of piezoelectric actuators 300 which are juxtaposed in the first direction X, it is possible to suppress the arising of a difference in the voltages which are applied to the piezoelectric actuators 300 of the X1 side and the piezoelectric actuators 300 of the X2 side to suppress variation in the displacement amounts of the piezoelectric actuators 300, and it is possible to reduce variation in the ejection properties of the ink droplets to improve the print quality.

Note that, in the same manner, in the second common wirings 92B, by providing the second common wirings 92B on the X1 side and the X2 side of the piezoelectric actuators 300 (the second drive elements 300B) of the Y2 side, it is possible to suppress a voltage drop of the second drive elements 300B to improve the print quality.

In the present embodiment, since a configuration is adopted in which the first common terminals 92*a* of the first common wirings 92A and the second common terminals 92*b* of the second common wirings 92B are juxtaposed on a straight line along which the first individual terminals 91*a* of the first individual wirings 91A and the second individual terminals 91*b* of the second individual wirings 91B are juxtaposed, it is possible to reduce the space which is necessary for connecting the flexible cable 120 to the terminals to obtain a reduction in size.

Note that, in the present embodiment, although the flexible cable 120, the intermediate substrate 230, and the outer wiring substrate 410 are not particularly depicted in FIG. 12, in the same manner as in the first embodiment described above, the first common connection wirings 123A, the first common intermediate wirings 233A, and the first common outer wirings 411A which are connected to the first common wirings 92A, and the second common connection wirings 123B, the second common intermediate wirings 233B, and the second common outer wirings 411B which are connected to the second common wirings 92B are provided independently without being connected to each other. Accordingly, it is possible to reliably suppress crosstalk without causing the first common wirings 92A to conduct with the second common wirings 92B.

In the present embodiment, although two of the first common wirings 92A are provided, at least one of the first common connection wiring 123A, the first common intermediate wiring 233A, and the first common outer wiring 411A which are connected to the first common wirings 92A may be provided for every two of the first common wirings 92A, or, only one may be provided for two of the first common wirings 92A. Naturally, the same applies to the second common connection wirings 123B, the second common intermediate wirings 233B, and the second common outer wirings 411B which are connected to the second common wirings 92B.

Figure 13:
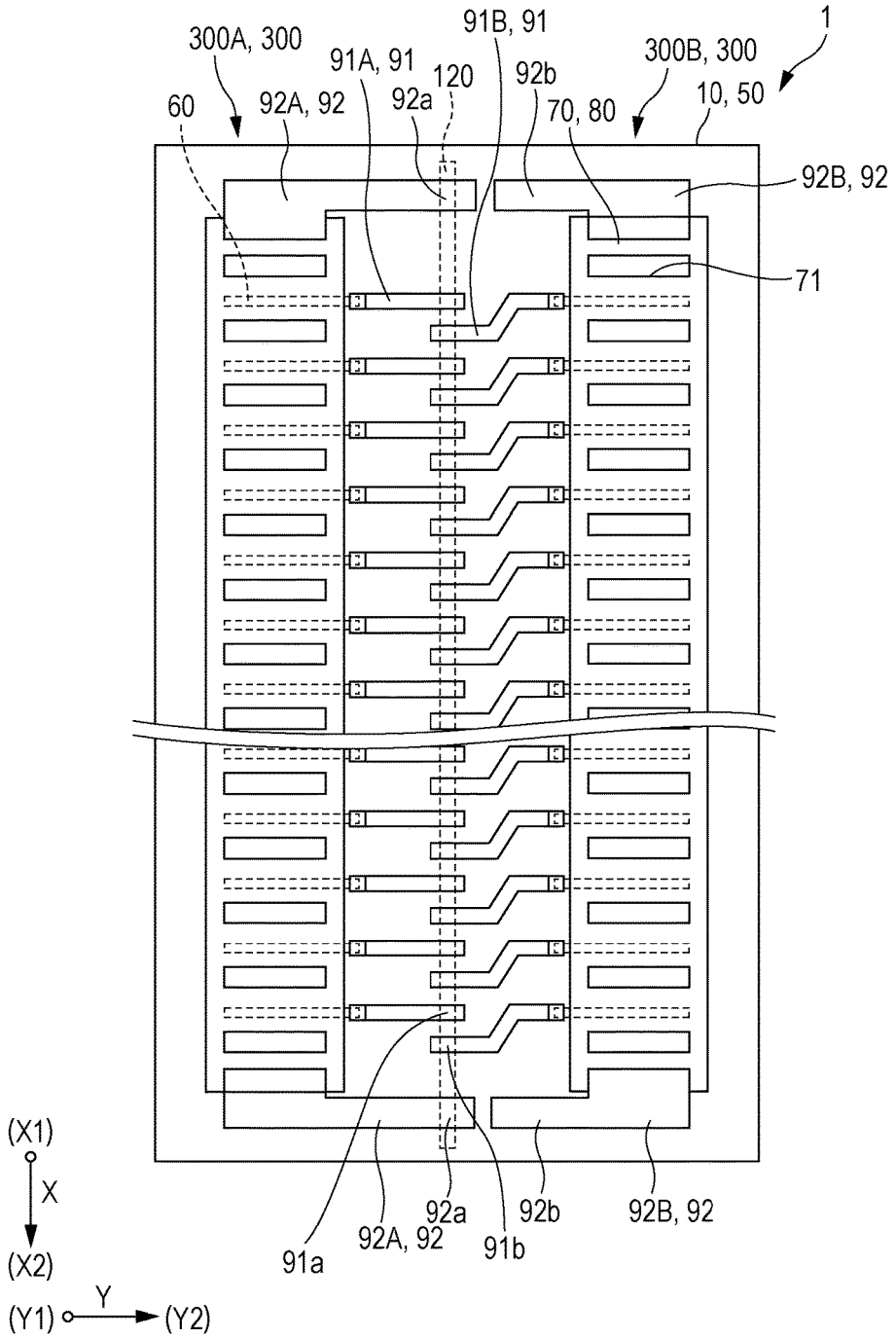
FIG. 13 is a plan view of the main components of a modification example of the recording head according to the second embodiment of the invention.

In the present embodiment, the first common terminals 92*a* of the first common wirings 92A and the second common terminals 92*b* of the second common wirings 92B are juxtaposed on a straight line in the first direction X; however, the embodiment is not limited thereto. For example, as illustrated in FIG. 13, the first common terminals 92*a* may be disposed along a straight line in which the first individual terminals 91*a* and the second individual terminals 91*b* are juxtaposed, and the second common terminals 92*b* may be disposed adjacent to the first common terminals 92*a* in the second direction Y. In this case, the flexible cable 120 and the second common terminals 92*b* may be connected to each other using another flexible substrate, or, another one of the flexible cables 120 may be connected to the first common terminals 92*a* and the second common terminals 92*b*.

Third Embodiment

Figure 14:
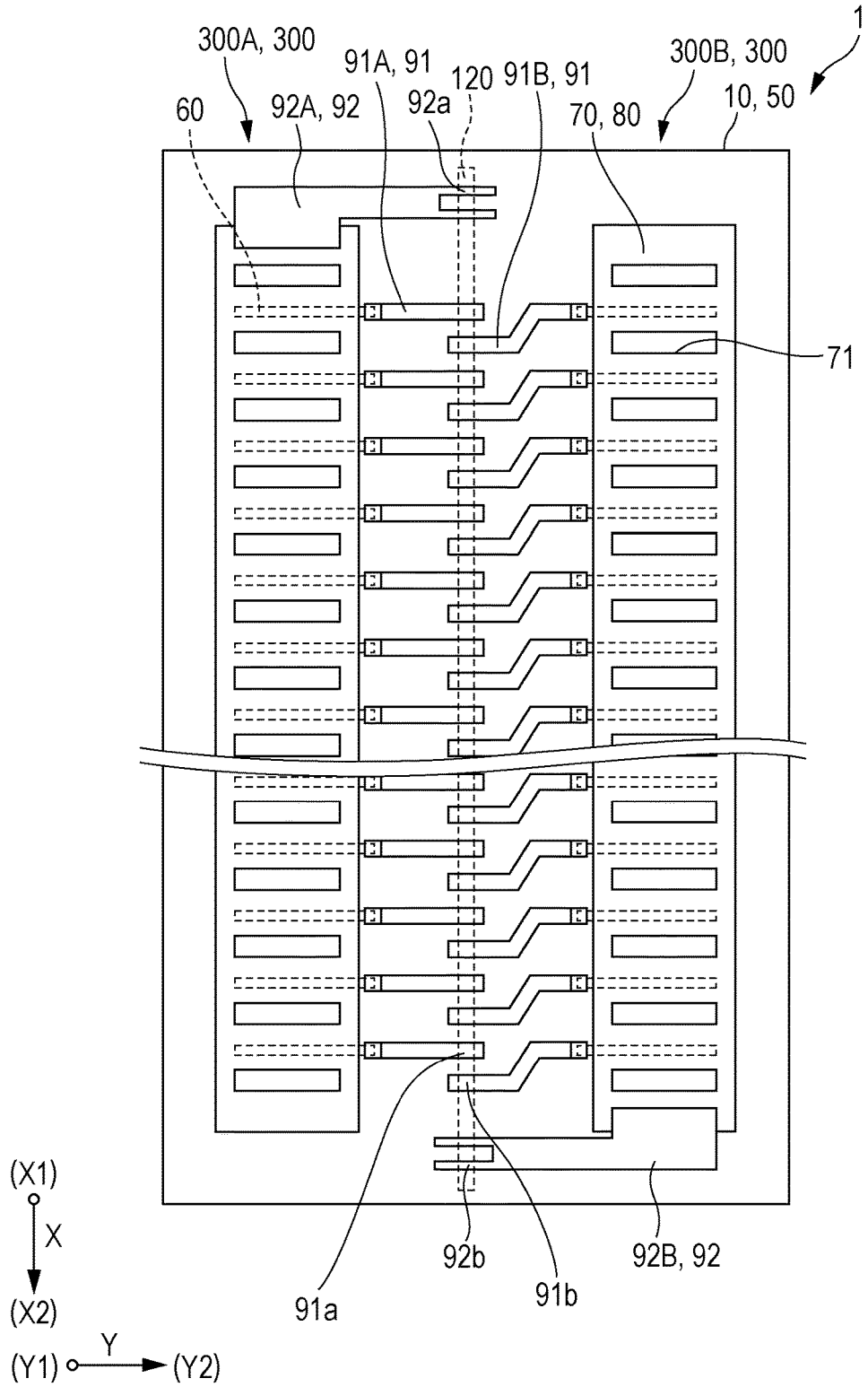
FIG. 14 is a plan view of the main components of a recording head according to a third embodiment of the invention.

FIG. 14 is a plan view of the main components of a recording head according to the third embodiment of the invention. Note that, members which are the same as those in the embodiment described above are assigned the same reference numerals, and redundant description will be omitted.

As illustrated in FIG. 14, in the present embodiment, the first common wiring 92A is provided on the X1 side on the second electrode 80 of the row of piezoelectric actuators 300 (the first drive elements 300A) of the Y1 side.

The opposite side from the end portion which is connected to the second electrode 80 of the first common connection wiring 92A branches into two, and two of the first common terminals 92*a* are juxtaposed in the first direction X. Although not particularly illustrated, the first common connection wiring 123A of the same flexible cable 120 as in the first embodiment described above is connected to the first common terminals 92*a*. Note that, the first common connection wiring 123A may be a single first common connection wiring 123A which is connected in common to the two first common terminals 92*a*, and may be a total of two first common connection wirings 123A, one connected to each of the two first common terminals 92*a*. Naturally, the first common connection wiring 123A may branch only at the terminal portion which is connected, in the same manner as in the first common wiring 92A.

The second common wiring 92B is provided on the X2 side on the second electrode 80 of the row of piezoelectric actuators 300 (the second drive elements 300B) of the Y2 side.

The opposite side from the end portion which is connected to the second electrode 80 of the second common connection wiring 92B branches into two, and two of the second common terminals 92*b* are juxtaposed in the first direction X. Although not particularly illustrated, the second common connection wiring 123B of the same flexible cable 120 as in the first embodiment described above is connected to the second common terminals 92*b*. Note that, the second common connection wiring 123B may be a single second common connection wiring 123B which is connected in common to the two second common terminals 92*b*, and may be a total of two second common connection wirings 123B, one connected to each of the two second common terminals 92*b*. Naturally, the second common connection wiring 123B may branch only at the terminal portion which is connected, in the same manner as in the second common wiring 92B.

In this manner, by providing two of the first common terminals 92*a* by branching the first common wiring 92A and providing two of the second common terminals 92*b* by branching the second common wiring 92B, the first common wiring 92A and the second common wiring 92B are connected to the first common connection wiring 123A and the second common connection wiring 123B of the flexible cable 120 at the connecting portions. Note that, in the present embodiment, although the first common wiring 92A and the second common wiring 92B are each branched into two, the embodiment is not particularly limited thereto, and the first common wiring 92A and the second common wiring 92B may each be branched into three or more.

Since by providing a plurality of each of the first common terminals 92*a* and the second common terminals 92*b*, it is possible to provide a plurality connection regions between the first common connection wiring 123A and the second common connection wiring 123B of the flexible cable 120, when an adhesive such as NCP or NCF is used in the joints between the first common terminals 92*a*, the second common terminals 92*b*, and the flexible cable 120, it is possible to allow excess adhesive to escape between the first common terminals 92*a* and between the second common terminals 92*b* which are adjacent in the first direction X, and it is possible to suppress faults such as connection faults which are caused by the excess adhesive. Incidentally, this is because, for example, when the area of a single connection region is provided widely, for example, to be wide in the first direction X, the excess adhesive on the first common terminals 92*a* and the second common terminals 92*b* may not be able to escape, will remain between the first common terminals 92*a* and the second common terminals 92*b*, and, the first common connection wiring 123A and the second common connection wiring 123B, and there is a concern that electrical connection faults will arise.

Fourth Embodiment

Figure 15:
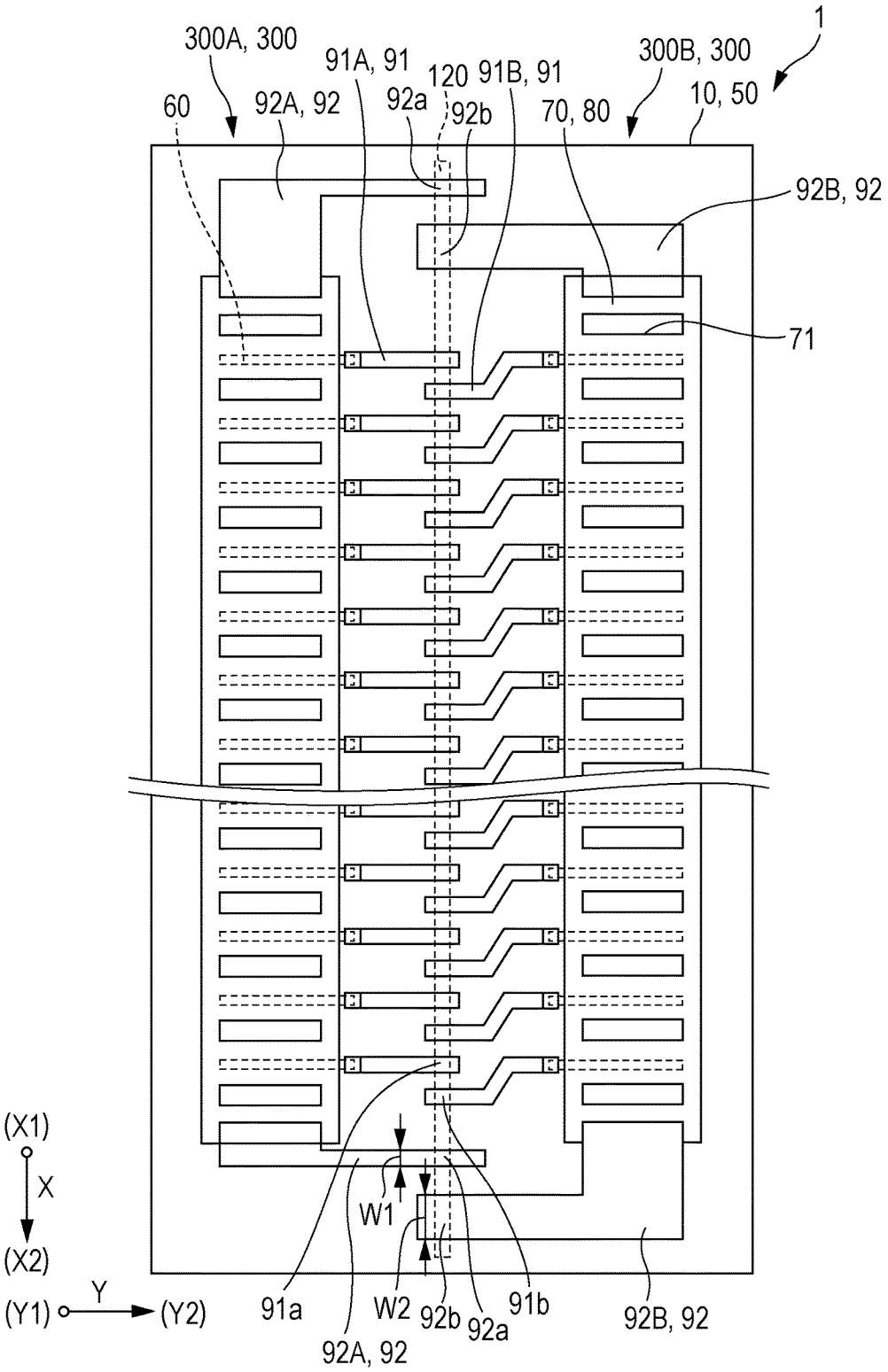
FIG. 15 is a plan view of the main components of a recording head according to a fourth embodiment of the invention.

FIG. 15 is a plan view of the main components of a recording head according to the fourth embodiment of the invention. Note that, members which are the same as those in the embodiment described above are assigned the same reference numerals, and redundant description will be omitted.

As illustrated in FIG. 15, in the present embodiment, in the same manner as in the second embodiment, the first common wirings 92A are led out from both sides in the first direction X in relation to one row of the piezoelectric actuators 300 which serve as the first drive elements 300A, and the second common wirings 92B are led out from both sides in the first direction X in relation to the other row of the piezoelectric actuators 300 which serve as the second drive elements 300B.

The first common terminal 92*a* of the first common wiring 92A of the first drive elements 300A, that is, the area which is connected to the flexible cable 120, has a different area from the second common terminal 92*b* of the second common wiring 92B of the second drive elements 300B, that is, the area which is connected to the flexible cable 120. In the present embodiment, by rendering a width W1 in the first direction X of the first common terminal 92*a* of the first common wiring 92A smaller than a width W2 in the first direction X of the second common terminal 92*b* of the second common wiring 92B, the area of the first common terminal 92*a* is rendered smaller than the area of the second common terminal 92*b*.

Here, in the present embodiment, the piezoelectric actuator 300 (the first drive element 300A) and the piezoelectric actuator 300 (the second drive element 300B) are driven by drive waveforms indicating different drive signals.

Specifically, description will be given of a first drive waveform which drives the first drive element 300A, and a second drive waveform which drives the second drive element 300B, with reference to FIGS. 16A and 16B. Note that, FIGS. 16A and 16B are drive waveforms indicating drive signals.

Figure 16A:
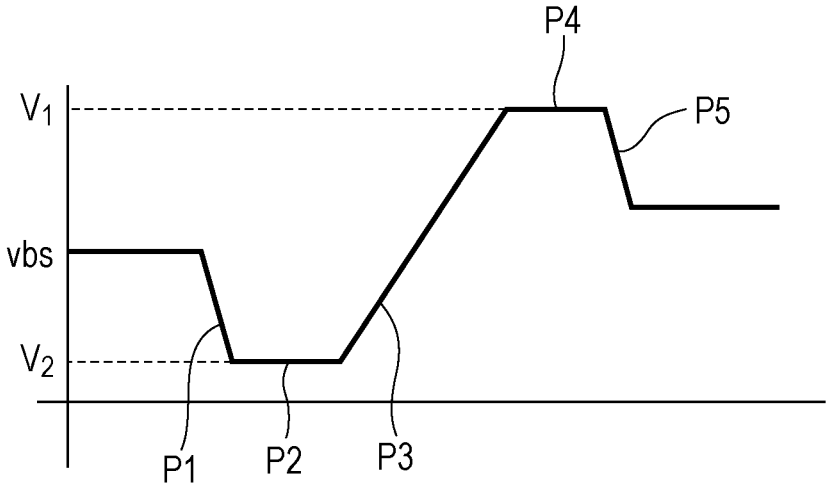
FIGS. 16A and 16B are drive waveforms illustrating drive signals according to the fourth embodiment of the invention.

As illustrated in FIG. 16A, the first drive waveform which drives the first drive element 300A is a waveform which causes an ink droplet to be ejected from the nozzle opening 21, the waveform including an expansion component P1, an expansion maintaining component P2, a contraction component P3, a contraction maintaining component P4, and an expansion restoration component P5. The expansion component P1 causes the pressure generating chamber 12 to expand by applying a first potential $V_1$ from a state in which the reference potential vbs is maintained, the expansion maintaining component P2 maintains the expended state for a fixed time, the contraction component P3 causes the pressure generating chamber 12 to contract by applying a second potential $V_2$ from the first potential $V_1$, the contraction maintaining component P4 maintains the contracted state for a fixed time, and the expansion restoration component P5 restores the pressure generating chamber 12 to the reference volume of the reference potential vbs from the contracted state of the second potential $V_2$. P1 to P5 are repeated at a fixed period.

Figure 16B:
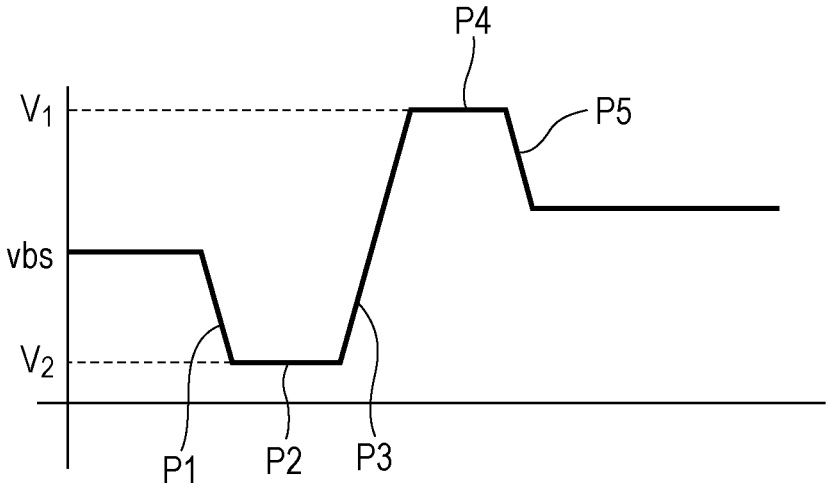

In contrast, as illustrated in FIG. 16B, the second waveform which drives the second drive element 300B is a waveform which causes an ink droplet to be ejected from the nozzle opening 21, and in the same manner as in the first drive waveform, includes the expansion component P1, the expansion maintaining component P2, the contraction component P3, the contraction maintaining component P4, and the expansion restoration component P5. The contraction component P3 of the second drive waveform is more inclined than the contraction component P3 of the first drive waveform, that is, the rate of potential variation per unit time is higher.

Since the contraction component P3 of the second drive waveform has a higher rate of potential variation per unit time in comparison to the contraction component P3 of the first drive waveform, the influence on a voltage drop of an electrical resistance value in a connecting portion between the second common wiring 92B of the second drive element 300B which is driven by the second drive waveform and the flexible cable 120 is greater than the influence on the voltage drop of the electrical resistance value in a connecting portion between the first common wiring 92A of the first drive element 300A which is driven by the first drive waveform and the flexible cable 120. Therefore, by rendering the area of the second common terminal 92*b*, which is the connecting portion between the second common wiring 92B and the flexible cable 120 in which the influence on the voltage drop is great, larger than the area of the first common terminal 92*a*, which is the connecting portion between the first common wiring 92A and the flexible cable 120, it is possible to reduce the electrical resistance value in the connecting portion to suppress the influence to the voltage drop.

In other words, in the present embodiment, the connection area of the connecting portion in which a voltage drop occurs easily is increased in size, and the connection area of the connecting portion in which a voltage drop does not occur easily is decreased in size. By reducing the area of the connecting portion between the first common wiring 92A and the flexible cable 120 at which the voltage drop does not occur easily in this manner, it is possible to reduce an installation region and obtain a reduction in the size of the recording head 2. In other words, this is because, when the first common wiring 92A is connected to the flexible cable 120 with the same area as the connection area between the second common wiring 92B and the flexible cable 120, space becomes necessary to form the first common terminal 92*a*, space becomes necessary to connect the flexible cable 120, and the size of the recording head 2 increases.

Note that, in the present embodiment, a configuration is illustrated in which the first drive elements 300A and the second drive elements 300B are driven using different drive waveforms as an example in which the voltage drop occurs easily; however, other causes are also conceivable as causes rendering the occurrence of the voltage drop easier. A conceivable example of another cause is a case in which, when the first drive elements 300A and the second drive elements 300B are driven using the same drive waveforms, the number of the piezoelectric actuators 300 (the first drive elements 300A) differs from the number of the piezoelectric actuators 300 (the second drive elements 300B). In other words, when the number of the piezoelectric actuators 300 (the first drive elements 300A) is few and the number of the piezoelectric actuators 300 (the second drive elements 300B) is many, the voltage drop occurs when the connection area between the second common wiring 92B and the flexible cable 120 is small when driving the piezoelectric actuators 300 (the second drive elements 300B) at the same time. Therefore, by increasing the contact area between the second common wiring 92B and the flexible cable 120, it is possible to reduce the electrical resistance value in the connecting portion to suppress the influence of a voltage drop when the piezoelectric actuators 300 are driven at the same time. By rendering the area of the first common terminal 92*a* of the first common wiring 92A smaller than that of the second common terminal 92*b* of the second common wiring 92B, it is possible to obtain a reduction in the size of the recording head 2.

Note that, as the case in which the number of the piezoelectric actuators 300 (the first drive elements 300A) is small, a case in which the rows of the piezoelectric actuators 300 which are juxtaposed in the first direction X are divided in the second direction Y and used is conceivable. For example, even when the number of the piezoelectric actuators 300 which are juxtaposed on the Y1 side is the same as those which are juxtaposed on the Y2 side, even when the same ink, for example, a black ink is ejected from the nozzle openings 21 corresponding to the row of the piezoelectric actuators 300 of the Y2 side, and the row of the piezoelectric actuators 300 of the Y1 side are divided into three, and, for example, cyan, magenta, and yellow inks are ejected from the nozzle openings 21 corresponding to the respective divided piezoelectric actuators 300, the number of the piezoelectric actuators 300 (the first drive elements 300A) of the Y2 side which eject each of the cyan, magenta, and yellow inks is smaller than the number of the piezoelectric actuators 300 (the second drive elements 300B) of the Y1 side which eject the black ink. Naturally, a configuration may be adopted in which the number of the piezoelectric actuators 300 of the Y1 side is a different number from the number of the piezoelectric actuators 300 of the Y2 side, and the row with the smaller number may be set as the first drive elements 300A.

EXAMPLES 1 to 3

In the recording head 2 which is the same as the one in the first embodiment described above, recording apparatuses of examples 1 to 3 are configured as in the following table 1, where A (V/μsec) is a total of the values obtained by dividing each of the potential differences (V) of the charging or discharging of the drive waveforms which drive the piezoelectric actuators 300 (the drive elements of the recording head 2) by the respective charging or discharging time (μsec), that is, a so-called sum of the slopes, B (m) is the length of the outer wiring substrate which is connected to the recording head 2, C ($m^2$) is the sectional area of the outer wiring substrate, and D (number) is the number of the piezoelectric actuators 300 which are driven in the single recording head 2. Note that, the charging and discharging include the expansion components and the contraction components of the drive waveforms, for example. In the first drive waveform illustrated in FIG. 16A, the potential difference of each of the charging or discharging of the drive waveform is a value obtained by obtaining the sum of the absolute value of the potential difference of the expansion component P1, the absolute value of the potential difference of the contraction component P3, and the absolute value of the potential difference of the expansion restoration component P5.

B is the length from one end portion of the outer wiring substrate 410 of the first embodiment described above which is connected to the intermediate substrate 230 of the head unit 1 to the other end portion which is connected to the control device 400.

C is the sectional area of the common outer wiring 411 of the outer wiring substrate 410.

D is the number of the piezoelectric actuators 300 which are driven in the single recording head 2 to which one of the common outer wirings 411 of the outer wiring substrate 410 is connected. In other words, in examples 1 and 2, 800 of the piezoelectric actuators 300 are driven in the single recording head 2, and in example 3, 400 of the piezoelectric actuators 300 are driven in the single recording head 2. Note that, as in a case of the recording head 2 of an embodiment other than the first embodiment, for example, it goes without saying that the recording head 2 in which there are two or more of the flexible cables 120 or the common outer wirings 411 is capable of suppressing the generation of crosstalk between the first drive elements 300A and the second drive elements 300B more than the recording head 2 of the first embodiment.

COMPARATIVE EXAMPLES 1 to 3

As the recording apparatuses of comparative examples 1 to 3, recording apparatuses are adopted which use a recording head in which the first common wiring and the second common wiring extracted from the first electrode, which is the common electrode of the two rows of piezoelectric actuators, are electrically connected to the recording head 2 of the first embodiment on the flow path forming substrate, and the same conditions A to D are used as in examples 1 to 3.

COMPARATIVE EXAMPLES 4 to 6

The recording apparatuses of comparative examples 4 to 6 are configured to have the same recording head as in comparative examples 1 to 3 in which the first electrodes of the two rows of piezoelectric actuators conduct with each other, using the values in the following table 1 for A to D.

TEST EXAMPLES

Evaluation was carried out of crosstalk in the recording apparatuses of examples 1 to 3 and comparative examples 1 to 6. The results are illustrated in the following table 1. Note that, the evaluation of crosstalk was performed by printing a test pattern on the recording sheet S according to the number of the piezoelectric actuators 300 indicated in condition D and measuring density irregularities in the printed result. Incidentally, from the printed result, although it is possible to observe both density irregularities caused by intra-row crosstalk of the piezoelectric actuators and density irregularities caused by inter-row crosstalk of the piezoelectric actuators, the results of observing the density irregularities caused by inter-row crosstalk of the piezoelectric actuators is illustrated in table 1.

TABLE 1

| | A (V/μsec) | B (m) | C ($m^2$) | D (number) | A*B*C*D | Crosstalk |
|---|---|---|---|---|---|---|
| Example 1 | 58.2 | 3 | 0.0000001 | 800 | 0.014 | ○ |
| Example 2 | 58.2 | 2 | 0.0000001 | 800 | 0.009 | ○ |
| Example 3 | 58.2 | 3 | 0.0000001 | 400 | 0.007 | ○ |
| Comparative Example 1 | 58.2 | 2 | 0.0000001 | 800 | 0.009 | x |
| Comparative Example 2 | 58.2 | 3 | 0.0000001 | 400 | 0.007 | x |
| Comparative Example 3 | 24.8 | 3 | 0.0000001 | 800 | 0.006 | ○ |
| Comparative Example 4 | 58.2 | 1 | 0.0000001 | 800 | 0.005 | ○ |
| Comparative Example 5 | 24.8 | 1 | 0.0000001 | 800 | 0.002 | ○ |
| Comparative Example 6 | | | | | | |

As illustrated in table 1, density irregularities caused by crosstalk were not observed in the recording heads 2 of examples 1 to 3. In contrast, density irregularities caused by crosstalk were observed in the recording heads of comparative examples 1 to 3 under the same conditions for A to D. Therefore, it is possible to suppress the inter-row crosstalk of the piezoelectric actuators, that is, crosstalk between the first drive elements and the second drive elements by adopting the configuration of the recording head 2 of the first embodiment when the result of multiplying A, B, C, and D is 0.007 or greater ($A*B*C*D \geq 0.007$).

When a long outer wiring substrate is used as the outer wiring substrate 410, the electrical resistance value of the wiring which is provided on the outer wiring substrate 410, specifically, the common outer wiring 411, increases, and crosstalk is generated easily. However, by using the recording head 2 of the configuration of the first embodiment as in examples 1 to 3, it is possible to suppress crosstalk without increasing the sectional area C of the common outer wiring 411 to reducing the electrical resistance value of the common outer wiring. Therefore, it is possible to increase the distance which the recording head 2 is caused to move reciprocally in the second direction Y. It is possible to perform the printing in the second direction Y, which is the direction in which the recording head 2 reciprocates, by causing ink droplets to land on the recording sheet S which is wide in the second direction Y.

In particular, in examples 1 to 3 described above, when the condition A is high, even when driving is carried out using a drive waveform with a large inclination total, it is possible to reliably suppress crosstalk. Incidentally, for example, the inclination total A of the drive waveform which ejects an ink droplet (a droplet) of a large dot becomes small, and the inclination total A of the drive waveform which ejects an ink droplet (a droplet) of a small dot becomes large. Therefore, even if the condition A is high and the drive waveform causes the small dot with the large inclination total to be ejected, it is possible to suppress crosstalk as long as the recording head 2 of the first embodiment described above is used.

In comparative examples 4 to 6, even in a configuration in which the first common wirings and the second common wirings of the two rows of piezoelectric actuators on the flow path forming substrate are caused to communicate with each other, crosstalk is not generated. Therefore, even in the conditions A to D of comparative examples 4 to 6, it is possible to suppress crosstalk even in a configuration which is the same as the recording head 2 of the embodiments described above or the like.

OTHER EMBODIMENTS

The embodiments of the invention are described above; however, the basic configuration of the invention is not limited to the above.

For example, in the embodiments described above, the first electrodes 60 are individual electrodes for each of the piezoelectric actuators 300 and the second electrode 80 is a common electrode for a plurality of the piezoelectric actuators 300; however, the embodiments are not particularly limited thereto, and the first electrode 60 may be a common electrode for a plurality of the piezoelectric actuators 300, and the second electrodes 80 may be individual electrodes for each of the piezoelectric actuators 300.

In the embodiments described above, the individual wirings 91 and the common wiring 92 are led out on the flow path forming substrate 10 (the diaphragms 50); however, the embodiments are not particularly limited thereto, and the individual wirings 91 and the common wiring 92 may be led out on the protective substrate 30. In other words, the individual wirings 91, the common wiring 92, and the flexible cable 120 may be connected on the protective substrate 30. Naturally, this is not limited to the protective substrate 30, and it is possible to apply the invention, even if the individual wirings 91 and the common wiring 92 are led out on another member which is joined to the flow path forming substrate 10 (the diaphragms 50).

In the embodiments described above, description is given of the thin-film piezoelectric actuator 300 which is used as the drive element which generates a pressure change in the pressure generating chamber 12. However, the invention is not particularly limited thereto, for example, a configuration may be adopted which uses a thick-film piezoelectric actuator which is formed using a method such as bonding green sheets, a longitudinal-oscillating piezoelectric actuator in which a piezoelectric material and an electrode forming material are alternately laminated and caused to expand and contract in the axial direction, or the like. As the drive element, it is possible to use a drive element in which a heating element is disposed within a pressure generating chamber and a droplet is ejected from a nozzle opening due to a bubble generated by the heating of the heating element. It is also possible to use a so-called electrostatic actuator which generates static electricity between a diaphragm and an electrode and causes a liquid droplet to be ejected from a nozzle opening by causing the diaphragm to deform using electrostatic force.

In the example described above, the ink jet recording apparatus I is configured such that the ink cartridges 9, which are liquid storage units, are installed in the carriage 3; however, the embodiment is not particularly limited thereto, for example, the liquid storage units such as ink tanks may be fixed to the apparatus main body 4, and the liquid storage units and the head unit 1 may be connected to each another via a supply tube such as a tube. The liquid storage units may not be installed in the ink jet recording apparatus.

In the ink jet recording apparatus I described above, a configuration is exemplified in which the head units 1 are installed in the carriage 3 and move in the main scanning direction; however, the embodiment is not particularly limited thereto, and, for example, the invention may be applied to a so-called line recording apparatus in which the head units 1 are fixed and printing is performed by only causing the recording sheet S such as paper to move in the sub-scanning direction.

The invention widely targets liquid ejecting heads in general. For example, the invention can be applied to recording heads such as various ink jet recording heads which are used in an image recording apparatus such as a printer, a color material ejecting head which is used in the manufacture of color filters of liquid crystal displays and the like, an electrode material ejecting head which is used in the electrode formation of organic EL displays, Field Emission Displays (FED) and the like, and a biological and organic matter ejecting head which is used in the manufacture of biochips. The ink jet recording apparatus I is described as an example of the liquid ejecting apparatus; however, it is possible to use a liquid ejecting apparatus which uses another liquid ejecting head described above.

What is claimed is:

1. A liquid ejecting head, comprising:

a first nozzle row in which nozzles which eject a liquid are juxtaposed along a first direction;

first drive elements which cause the liquid to be ejected from each nozzle of the first nozzle row;

a plurality of first individual wirings which are connected to the first drive elements;

a first common wiring which is connected in common to the first drive elements;

a second nozzle row in which nozzles are juxtaposed along the first direction;

second drive elements which cause the liquid to be ejected from each nozzle of the second nozzle row;

a plurality of second individual wirings which are connected to the second drive elements; and a second common wiring which is connected in common to the second drive elements and is not connected to the first common wiring, wherein the first common wiring are arranged along a plane where the second common wiring are arranged, and wherein the plurality of first individual wirings, the first common wiring, the second individual wirings, and the second common wiring are connected to a common flexible cable.

2. The liquid ejecting head according to claim 1, wherein the flexible cable includes a first common connection wiring which is connected to the first common wiring, and a second common connection wiring which is connected to the second common wiring, and wherein the first common connection wiring and the second common connection wiring are provided independently without being connected to each other on the flexible cable.

3. A liquid ejecting apparatus, comprising:

the liquid ejecting head according to claim 2, an intermediate substrate which is connected to the flexible cable;

a holding member which holds the intermediate substrate; and an outer wiring substrate, one end of which is connected to the intermediate substrate, the other end of which is connected to a control device, wherein the intermediate substrate moves reciprocally relative to the control device, wherein the outer wiring substrate follows the reciprocal movement of the intermediate substrate, and wherein $A*B*C*D \geq 0.007$, where A (V/μsec) is a total of values obtained by dividing each potential difference (V) of charging or discharging of drive waveforms which drive the first drive elements and the second drive elements by a respective charging or discharging time (μsec), B(m) is a length of the outer wiring substrate, C($m^2$) is a sectional area of the outer wiring substrate, and D(number) is a number of the first drive elements and the second drive elements which are driven.

4. A liquid ejecting head unit, comprising:

the liquid ejecting head according to claim 2;

an intermediate substrate which is connected to the flexible cable;

a holding member which holds the intermediate substrate; and an outer wiring substrate which is connected to the intermediate substrate, wherein the flexible cable includes a first common connection wiring which is connected to the first common wiring, and a second common connection wiring which is connected to the second common wiring, wherein the first common connection wiring and the second common connection wiring are provided independently without being connected to each other on the flexible cable, wherein the intermediate substrate includes a first common intermediate wiring which is connected to the first common connection wiring, and a second common intermediate wiring which is connected to the second common connection wiring, wherein the first common intermediate wiring and the second common intermediate wiring are provided independently without being connected to each other on the intermediate substrate, wherein the outer wiring substrate includes a first common outer wiring which is connected to the first common intermediate wiring, and a second common outer wiring which is connected to the second common intermediate wiring, and wherein the first common outer wiring and the second common outer wiring are provided independently without being connected to each other on the outer wiring substrate.

5. The liquid ejecting head according to claim 1, wherein the first common wiring and the second common wiring each has a plurality of connection regions which are connected to the common flexible cable, wherein a plurality of the first common wirings are disposed on one side in the first direction in relation to the plurality of first individual wirings and the plurality of second individual wirings, and wherein a plurality of the second common wirings are disposed on another side in the first direction in relation to the plurality of first individual wirings and the plurality of second individual wirings.

6. A liquid ejecting apparatus, comprising:

the liquid ejecting head according to claim 5, an intermediate substrate which is connected to the flexible cable;

a holding member which holds the intermediate substrate; and an outer wiring substrate, one end of which is connected to the intermediate substrate, the other end of which is connected to a control device, wherein the intermediate substrate moves reciprocally relative to the control device, wherein the outer wiring substrate follows the reciprocal movement of the intermediate substrate, and wherein $A*B*C*D \geq 0.007$, where A (V/μsec) is a total of values obtained by dividing each potential difference (V) of charging or discharging of drive waveforms which drive the first drive elements and the second drive elements by a respective charging or discharging time (μsec), B(m) is a length of the outer wiring substrate, C($m^2$) is a sectional area of the outer wiring substrate, and D(number) is a number of the first drive elements and the second drive elements which are driven.

7. A liquid ejecting head unit, comprising:

the liquid ejecting head according to claim 5;

an intermediate substrate which is connected to the flexible cable;

a holding member which holds the intermediate substrate; and an outer wiring substrate which is connected to the intermediate substrate, wherein the flexible cable includes a first common connection wiring which is connected to the first common wiring, and a second common connection wiring which is connected to the second common wiring, wherein the first common connection wiring and the second common connection wiring are provided independently without being connected to each other on the flexible cable, wherein the intermediate substrate includes a first common intermediate wiring which is connected to the first common connection wiring, and a second common intermediate wiring which is connected to the second common connection wiring, wherein the first common intermediate wiring and the second common intermediate wiring are provided independently without being connected to each other on the intermediate substrate, wherein the outer wiring substrate includes a first common outer wiring which is connected to the first common intermediate wiring, and a second common outer wiring which is connected to the second common intermediate wiring, and wherein the first common outer wiring and the second common outer wiring are provided independently without being connected to each other on the outer wiring substrate.

8. The liquid ejecting head according to claim 1, wherein the first common wiring and the second common wiring each has a plurality of connection regions which are connected to the common flexible cable, wherein a plurality of the first common wirings are disposed on both one side and another side in the first direction in relation to the plurality of first individual wirings and the plurality of second individual wirings, and wherein a plurality of the second common wirings are disposed on both the one side and the other side in the first direction in relation to the plurality of first individual wirings and the plurality of second individual wirings.

9. A liquid ejecting apparatus, comprising:

the liquid ejecting head according to claim 8, an intermediate substrate which is connected to the flexible cable;

a holding member which holds the intermediate substrate; and an outer wiring substrate, one end of which is connected to the intermediate substrate, the other end of which is connected to a control device, wherein the intermediate substrate moves reciprocally relative to the control device, wherein the outer wiring substrate follows the reciprocal movement of the intermediate substrate, and wherein A*B*C*D≥0.007, where A (V/μsec) is a total of values obtained by dividing each potential difference (V) of charging or discharging of drive waveforms which drive the first drive elements and the second drive elements by a respective charging or discharging time (μsec), B(m) is a length of the outer wiring substrate, C($m^2$) is a sectional area of the outer wiring substrate, and D(number) is a number of the first drive elements and the second drive elements which are driven.

10. A liquid ejecting head unit, comprising:

the liquid ejecting head according to claim 8;

an intermediate substrate which is connected to the flexible cable;

a holding member which holds the intermediate substrate; and an outer wiring substrate which is connected to the intermediate substrate, wherein the flexible cable includes a first common connection wiring which is connected to the first common wiring, and a second common connection wiring which is connected to the second common wiring, wherein the first common connection wiring and the second common connection wiring are provided independently without being connected to each other on the flexible cable, wherein the intermediate substrate includes a first common intermediate wiring which is connected to the first common connection wiring, and a second common intermediate wiring which is connected to the second common connection wiring, wherein the first common intermediate wiring and the second common intermediate wiring are provided independently without being connected to each other on the intermediate substrate, wherein the outer wiring substrate includes a first common outer wiring which is connected to the first common intermediate wiring, and a second common outer wiring which is connected to the second common intermediate wiring, and wherein the first common outer wiring and the second common outer wiring are provided independently without being connected to each other on the outer wiring substrate.

11. The liquid ejecting head according to claim 1, wherein the plurality of first individual wirings, the first common wiring, the plurality of second individual wirings, and the second common wiring are disposed to be juxtaposed on a straight line in a connection region in which the same are connected to the common flexible cable.

12. A liquid ejecting head unit, comprising:

the liquid ejecting head according to claim 11;

an intermediate substrate which is connected to the flexible cable;

a holding member which holds the intermediate substrate; and an outer wiring substrate which is connected to the intermediate substrate, wherein the flexible cable includes a first common connection wiring which is connected to the first common wiring, and a second common connection wiring which is connected to the second common wiring, wherein the first common connection wiring and the second common connection wiring are provided independently without being connected to each other on the flexible cable, wherein the intermediate substrate includes a first common intermediate wiring which is connected to the first common connection wiring, and a second common intermediate wiring which is connected to the second common connection wiring, wherein the first common intermediate wiring and the second common intermediate wiring are provided independently without being connected to each other on the intermediate substrate, wherein the outer wiring substrate includes a first common outer wiring which is connected to the first common intermediate wiring, and a second common outer wiring which is connected to the second common intermediate wiring, and wherein the first common outer wiring and the second common outer wiring are provided independently without being connected to each other on the outer wiring substrate.

13. The liquid ejecting head according to claim 1, wherein areas of connection regions in which the plurality of first individual wirings and the plurality of second individual wirings are connected to the common flexible cable differ from each other.

14. A liquid ejecting apparatus, comprising:

the liquid ejecting head according to claim 1, an intermediate substrate which is connected to the flexible cable;

a holding member which holds the intermediate substrate; and an outer wiring substrate, one end of which is connected to the intermediate substrate, the other end of which is connected to a control device, wherein the intermediate substrate moves reciprocally relative to the control device, wherein the outer wiring substrate follows the reciprocal movement of the intermediate substrate, and wherein A*B*C*D≥0.007, where A (V/μsec) is a total of values obtained by dividing each potential difference (V) of charging or discharging of drive waveforms which drive the first drive elements and the second drive elements by a respective charging or discharging time (μsec), B(m) is a length of the outer wiring substrate, C($m^2$) is a sectional area of the outer wiring substrate, and D(number) is a number of the first drive elements and the second drive elements which are driven.

15. A liquid ejecting head unit, comprising:

the liquid ejecting head according to claim 1;

an intermediate substrate which is connected to the flexible cable;

a holding member which holds the intermediate substrate; and an outer wiring substrate which is connected to the intermediate substrate, wherein the flexible cable includes a first common connection wiring which is connected to the first common wiring, and a second common connection wiring which is connected to the second common wiring, wherein the first common connection wiring and the second common connection wiring are provided independently without being connected to each other on the flexible cable, wherein the intermediate substrate includes a first common intermediate wiring which is connected to the first common connection wiring, and a second common intermediate wiring which is connected to the second common connection wiring, wherein the first common intermediate wiring and the second common intermediate wiring are provided independently without being connected to each other on the intermediate substrate, wherein the outer wiring substrate includes a first common outer wiring which is connected to the first common intermediate wiring, and a second common outer wiring which is connected to the second common intermediate wiring, and wherein the first common outer wiring and the second common outer wiring are provided independently without being connected to each other on the outer wiring substrate.

16. The liquid ejecting head unit according to claim 15, wherein a plurality of the flexible cables are provided, and the plurality of flexible cables are connected in common to the intermediate substrate.

17. A liquid ejecting apparatus, comprising:

the liquid ejecting head according to claim 1.

18. A liquid ejecting apparatus, comprising:

the liquid ejecting head unit according to claim 15.

19. A liquid ejecting head, comprising:

a first nozzle row in which nozzles which eject a liquid are juxtaposed along a first direction;

first drive elements which cause the liquid to be ejected from each nozzle of the first nozzle row;

a plurality of first individual wirings which are connected to the first drive elements;

a first common wiring which is connected in common to the first drive elements;

a second nozzle row in which nozzles are juxtaposed along the first direction;

second drive elements which cause the liquid to be ejected from each nozzle of the second nozzle row;

a plurality of second individual wirings which are connected to the second drive elements; and a second common wiring which is connected in common to the second drive elements and is not connected to the first common wiring, wherein the plurality of first individual wirings, the first common wiring, the second individual wirings, and the second common wiring are connected to a common flexible cable, wherein the flexible cable includes a first common connection wiring which is connected to the first common wiring, and a second common connection wiring which is connected to the second common wiring, and wherein the first common connection wiring and the second common connection wiring are provided independently without being connected to each other on the flexible cable.

20. A liquid ejecting apparatus, comprising:

a liquid ejecting head, comprising:

a first nozzle row in which nozzles which eject a liquid are juxtaposed along a first direction;

first drive elements which cause the liquid to be ejected from each nozzle of the first nozzle row;

a plurality of first individual wirings which are connected to the first drive elements;

a first common wiring which is connected in common to the first drive elements;

a second nozzle row in which nozzles are juxtaposed along the first direction;

second drive elements which cause the liquid to be ejected from each nozzle of the second nozzle row;

a plurality of second individual wirings which are connected to the second drive elements; and a second common wiring which is connected in common to the second drive elements and is not connected to the first common wiring, wherein the plurality of first individual wirings, the first common wiring, the second individual wirings, and the second common wiring are connected to a common flexible cable, an intermediate substrate which is connected to the flexible cable;

a holding member which holds the intermediate substrate; and an outer wiring substrate, one end of which is connected to the intermediate substrate, the other end of which is connected to a control device, wherein the intermediate substrate moves reciprocally relative to the control device, wherein the outer wiring substrate follows the reciprocal movement of the intermediate substrate, and wherein $A*B*C*D \geq 0.007$, where A (V/μsec) is a total of values obtained by dividing each potential difference (V) of charging or discharging of drive waveforms which drive the first drive elements and the second drive elements by a respective charging or discharging time (μsec), B(m) is a length of the outer wiring substrate, C($m^2$) is a sectional area of the outer wiring substrate, and D(number) is a number of the first drive elements and the second drive elements which are driven.

* * * * *